US006793311B2

(12) United States Patent
Baba et al.

(10) Patent No.: US 6,793,311 B2
(45) Date of Patent: Sep. 21, 2004

(54) INK JET RECORDING APPARATUS

(75) Inventors: Koichi Baba, Osaka (JP); Koji Ikeda, Hyogo (JP); Koji Matsuo, Fukuoka (JP); Masashi Tomita, Kumamoto (JP); Masaharu Oyama, Fukuoka (JP); Masaichiro Tatekawa, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/265,341

(22) Filed: Oct. 4, 2002

(65) Prior Publication Data

US 2003/0122888 A1 Jul. 3, 2003

(30) Foreign Application Priority Data

Oct. 5, 2001 (JP) ..... 2001-310541
Aug. 8, 2002 (JP) ..... 2002-231515

(51) Int. Cl.[7] ..... B41J 29/393
(52) U.S. Cl. ..... 347/19
(58) Field of Search ..... 347/19, 10, 12, 347/11, 5, 9, 14, 23, 15, 40, 41, 43, 37, 16, 8, 104, 105, 91; 358/298

(56) References Cited

U.S. PATENT DOCUMENTS 5,285,215 A 2/1994 Liker ..... 347/11
6,331,040 B1 * 12/2001 Yonekubo et al. ..... 347/15
6,450,604 B1 * 9/2002 Iwaishi et al. ..... 347/10

FOREIGN PATENT DOCUMENTS

| | | |
|---|---|---|
| JP | 59-133066 | 7/1984 |
| JP | 08336970 A | 12/1996 |
| JP | 10081012 A | 3/1998 |
| JP | 10081014 A | 3/1998 |
| JP | 10193587 A | 7/1998 |
| JP | 11058729 A | 3/1999 |
| JP | 2001138551 A | 5/2001 |
| JP | 2001353886 A | 12/2001 |
| JP | 2002001948 A | 1/2002 |

* cited by examiner

*Primary Examiner*—Stephen D. Meier
*Assistant Examiner*—Charles Stewart, Jr.
(74) *Attorney, Agent, or Firm*—Harness, Dickey & Pierce, P.L.C.

(57) ABSTRACT

An ink jet recording apparatus includes: a head body provided with a nozzle and a pressure chamber; an actuator including a piezoelectric element and an electrode for applying a voltage across the piezoelectric element; and a driving circuit for supplying a driving signal to the electrode of the actuator. The driving signal includes, in one printing cycle, a pulse signal applied with an interval that is shorter than a predetermined pulse interval being equal to a Helmholtz period of a head, and a pulse signal applied with an interval that is longer than the predetermined pulse interval.

30 Claims, 14 Drawing Sheets

INK JET RECORDING APPARATUS

FIELD OF THE INVENTION

The present invention relates to an ink jet recording apparatus.

BACKGROUND OF THE INVENTION

A type of ink jet recording apparatus known in the art discharges a plurality of ink droplets from the same nozzle of an ink jet head in one printing cycle so that a single ink dot is formed from these ink droplets. A recording apparatus of this type arranges a plurality of ink dots on recording paper so that the ink dots together form an image, etc., on the recording paper. The number of ink droplets to be discharged in one printing cycle is adjusted so as to adjust the gradation and the size of the dot, thereby realizing so-called "multiple gray level recording".

However, when printing at a high speed, the carriage of the ink jet head is moved at a high velocity, whereby the landing positions of the ink droplets discharged from the same nozzle are likely to be shifted from one another in the carriage direction. Then, the ink dot formed from the ink droplets will have an oblong circular shape elongated in the carriage direction, thereby lowering the image quality.

In view of this, a method for enabling high-speed printing has been proposed in the art, in which two ink droplets are discharged from the same nozzle with the later discharged ink droplet being discharged with a higher discharging velocity than that of the previously discharged ink droplet so that the two ink droplets are allowed to merge in flight into a single ink droplet before landing, as disclosed in, for example, Japanese Laid-Open Patent Publication No. 59-133066.

In recent years, the density of an ink jet head has been increasing, whereby the dimensional error in an actuator, or other elements, the change over time in the characteristics of an actuator, etc., have an increasing influence on the ink droplet discharging velocity. Specifically, if an actuator, a pressure chamber, etc., has a dimensional error, or the like, the degree of deformation of the actuator or the behavior of ink in the pressure chamber in response to a driving signal will be different from those in a case where there is no dimensional error, or the like, for the same driving signal. Thus, if the dimensional error, or the like, varies among different actuators, the ink droplet discharging velocity will also vary among different nozzles. Such variations in the ink droplet discharging velocity lead to variations in the landing position, thereby resulting in deteriorations in the image quality such as a white streak in a solid print, for example. Particularly, with an ink jet head that discharges a plurality of ink droplets that are merged together in flight, such as that disclosed in the above publication, the error in the discharging velocity among different ink droplets is amplified, whereby variations in the landing position are likely to occur.

By matching the vibration period of an actuator with the natural vibration period thereof, it is possible to bring the actuator into resonance and to bring the ink meniscus vibration into resonance. In this way, it is possible to drive the actuator with a smaller amount of energy. Thus, it is possible to improve the discharging performance by effectively utilizing resonance.

Note that the term "vibration period of an actuator" as used herein refers to the vibration period of the entire vibration system including the ink, etc., i.e., the vibration period of the actuator with the pressure chamber, etc., being filled with ink. Similarly, the term "resonance frequency, or the like, of an actuator" as used herein refers to the resonance frequency, or the like, of the entire vibration system including the ink, etc.

However, even with an ink jet head utilizing resonance, if the resonance frequency varies among different actuators, the discharging velocity or the discharged ink volume will vary among different nozzles, thereby leading to a shift in the ink droplet landing position or variations in the ink dot size. Such variations in the landing position or the ink dot size will cause irregularities in the arrangement of ink dots on the recording paper, thereby lowering the image quality. Particularly, with an ink jet head that discharges a plurality of ink droplets that are merged together in flight, the discharging velocity or the discharged ink volume easily vary due to a shift in the resonance frequency. Effective countermeasures have not been taken in the prior art against such variations in the discharging velocity or the discharged ink volume due to a shift in the resonance frequency.

SUMMARY OF THE INVENTION

The present invention has been made in view of the above, and has an object to improve the recording quality by reducing the variations in the discharging velocity among nozzles.

Another object of the present invention is to provide an ink jet recording apparatus that utilizes resonance and discharges a plurality of ink droplets that are merged together in flight, in which the recording quality is improved by suppressing the variations in the discharging velocity or the discharged ink volume of a merged ink droplet.

An ink jet recording apparatus of the present invention includes: a head body provided with a plurality of nozzles and a plurality of pressure chambers, which are communicated to the respective nozzles and are filled with ink; a plurality of actuators provided in the head body each including a piezoelectric element and an electrode for applying a voltage across the piezoelectric element for applying a pressure on the ink in one of the pressure chambers so as to discharge ink from one of the nozzles; and a driving circuit for supplying a signal to the electrode of each actuator, wherein: the driving circuit applies, in one printing cycle, a driving signal composed of a plurality of pulse signals for discharging a plurality of ink droplets so that the ink droplets are merged together in flight; and the driving signal includes a pulse signal applied with an interval that is shorter than a predetermined pulse interval being equal to a Helmholtz period of a head, and a pulse signal applied with an interval that is longer than the predetermined pulse interval.

Note that the term "Helmholtz period of a head" as used herein refers to the natural period of the entire vibration system including the ink (an acoustic element), the actuator, etc.

Theoretically, the degree of resonance of the ink meniscus vibration increases as the pulse interval of a pulse signal is closer to the Helmholtz period. Therefore, the ink droplet discharging velocity increases as the pulse interval is closer to the Helmholtz period.

In this ink jet recording apparatus, the plurality of pulse signals to be applied in one printing cycle include a pulse signal applied with an interval that is shorter than the Helmholtz period, and a pulse signal applied with an interval that is longer than the Helmholtz period. Therefore, if the Helmholtz period shifts due to various factors such as a dimensional error in the actuator, the pressure chamber, etc., or a change in the characteristics of the actuator, the discharging velocity of one ink droplet may be increased by such a shift in the Helmholtz period while the discharging velocity of another ink droplet may be decreased by the shift. As a result, the shift component that increases the discharging velocity of the merged ink droplet (i.e., an ink droplet whose discharging velocity increases due to the shift in the Helmholtz period) and the shift component that decreases the discharging velocity of the merged ink droplet (i.e., an ink droplet whose discharging velocity decreases due to the shift in the Helmholtz period) are canceled out by each other to some degree, thereby suppressing the shift in the discharging velocity of the merged ink droplet. Thus, variations in the discharging velocity among different nozzles are reduced. Therefore, variations in the ink droplet landing position are reduced, thereby improving the recording quality.

Another ink jet recording apparatus of the present invention includes: a head body provided with a plurality of nozzles and a plurality of pressure chambers, which are communicated to the respective nozzles and are filled with ink; a plurality of actuators provided in the head body each including a piezoelectric element and an electrode for applying a voltage across the piezoelectric element for applying a pressure on the ink in one of the pressure chambers so as to discharge ink from one of the nozzles; and a driving circuit for supplying a signal to the electrode of each actuator, wherein: the driving circuit applies, in one printing cycle, a driving signal composed of a plurality of pulse signals for discharging a plurality of ink droplets so that the ink droplets are merged together in flight; and the driving signal includes a pulse signal applied with an interval that is shorter than a predetermined pulse interval that maximizes an ink droplet discharging velocity, and a pulse signal applied with an interval that is longer than the predetermined pulse interval.

Theoretically, a pulse interval that maximizes the ink droplet discharging velocity is the time interval that is equal to the Helmholtz period of the head, as described above. In practice, however, the discharging velocity may be maximized when the pulse interval is equal to a predetermined interval that is slightly shifted from the Helmholtz period. This may be due to various uncertainties such as the interference between adjacent actuators. Note however that such a predetermined pulse interval can be uniquely determined in advance by an experiment, etc.

In this ink jet recording apparatus, the plurality of pulse signals to be applied in one printing cycle include a pulse signal applied with an interval that is shorter than the predetermined pulse interval, and a pulse signal applied with an interval that is longer than the predetermined pulse interval. Thus, as in the previous ink jet recording apparatus described above, variations in the discharging velocity among different nozzles are suppressed, thereby improving the recording quality.

The plurality of pulse signals included in the driving signal may be applied in an order such that an absolute value of a difference between the pulse interval thereof and the predetermined pulse interval gradually decreases.

The driving signal may include a first pulse signal, a second pulse signal and a third pulse signal; and two of the first to third pulse signals may have pulse intervals that are shorter than the predetermined pulse interval, with the other pulse signal having a pulse interval that is longer than the predetermined pulse interval.

The driving signal may include a first pulse signal, a second pulse signal and a third pulse signal; and two of the first to third pulse signals may have pulse intervals that are longer than the predetermined pulse interval, with the other pulse signal having a pulse interval that is shorter than the predetermined pulse interval.

Still another ink jet recording apparatus of the present invention includes: a head body provided with a plurality of nozzles and a plurality of pressure chambers, which are communicated to the respective nozzles and are filled with ink; a plurality of actuators provided in the head body each including a piezoelectric element and an electrode for applying a voltage across the piezoelectric element for applying a pressure on the ink in one of the pressure chambers so as to discharge ink from one of the nozzles; and a driving circuit for supplying a signal to the electrode of each actuator, wherein: the driving circuit applies, in one printing cycle, a driving signal composed of a plurality of pulse signals for discharging a plurality of ink droplets so that the ink droplets are merged together in flight; and the driving signal includes a pulse signal having a pulse width that is shorter than a predetermined pulse width being equal to one half of a Helmholtz period of a head, and a pulse signal having a pulse width that is longer than the predetermined pulse width.

Theoretically, the degree of resonance of the ink meniscus vibration increases as the pulse width of a pulse signal is closer to a half period, i.e., one half of the Helmholtz period of the head. Therefore, the ink droplet discharging velocity increases as the pulse width of the pulse signal is closer to a predetermined pulse width that is equal to the half period.

In this ink jet recording apparatus, the plurality of pulse signals to be applied in one printing cycle include a pulse signal having a pulse width that is shorter than the predetermined pulse width, and a pulse signal having a pulse width that is longer than the predetermined pulse width. Therefore, even if the Helmholtz period shifts due to various factors such as a dimensional error in the actuator, the pressure chamber, etc., the shift component that decreases the ink droplet discharging velocity and the shift component that increases the ink droplet discharging velocity are canceled out by each other to some degree, thereby suppressing the shift in the discharging velocity of the merged ink droplet. Thus, variations in the discharging velocity among different nozzles are reduced, thereby improving the recording quality.

Still another ink jet recording apparatus of the present invention includes: a head body provided with a plurality of nozzles and a plurality of pressure chambers, which are communicated to the respective nozzles and are filled with ink; a plurality of actuators provided in the head body each including a piezoelectric element and an electrode for applying a voltage across the piezoelectric element for applying a pressure on the ink in one of the pressure chambers so as to discharge ink from one of the nozzles; and a driving circuit for supplying a signal to the electrode of each actuator, wherein: the driving circuit applies, in one printing cycle, a driving signal composed of a plurality of pulse signals for discharging a plurality of ink droplets so that the ink droplets are merged together in flight; and the driving signal includes a pulse signal having a pulse width that is shorter than a predetermined pulse width that maximizes an ink droplet discharging velocity, and a pulse signal having a pulse width that is longer than the predetermined pulse width.

Theoretically, a pulse width that maximizes the ink droplet discharging velocity is the pulse width that is equal to the half period of the Helmholtz period of the head, as described above. In practice, however, the discharging velocity may be maximized when the pulse width is equal to a predetermined pulse width that is slightly shifted from the half period. This may be due to various uncertainties such as the interference between adjacent actuators. Note however that such a predetermined pulse width can be uniquely determined in advance by an experiment, etc.

In this ink jet recording apparatus, the plurality of pulse signals to be applied in one printing cycle include a pulse signal having a pulse width that is shorter than the predetermined pulse width, and a pulse signal having a pulse width that is longer than the predetermined pulse width. Thus, as in the previous ink jet recording apparatus described above, variations in the discharging velocity among different nozzles are suppressed, thereby improving the recording quality.

The plurality of pulse signals included in the driving signal may be applied in an order such that an absolute value of a difference between the pulse width thereof and the predetermined pulse width gradually decreases.

The driving signal may include a first pulse signal, a second pulse signal and a third pulse signal; and two of the first to third pulse signals may have pulse widths that are shorter than the predetermined pulse width, with the other pulse signal having a pulse width that is longer than the predetermined pulse width.

The driving signal may include a first pulse signal, a second pulse signal and a third pulse signal; and two of the first to third pulse signals may have pulse widths that are longer than the predetermined pulse width, with the other pulse signal having a pulse width that is shorter than the predetermined pulse width.

A thickness of the piezoelectric element may be set to be 0.5 $\mu$m to 5 $\mu$m.

When the piezoelectric element has a reduced thickness, a dimensional error in the actuator, the pressure chamber, etc., are likely to have a significant influence on the discharging velocity, whereby the effect of reducing the variations in the discharging velocity among different nozzles is more pronounced.

Still another ink jet recording apparatus of the present invention includes: a head body provided with a plurality of nozzles and a plurality of pressure chambers, which are communicated to the respective nozzles and are filled with ink; a plurality of actuators provided in the head body each including a piezoelectric element and an electrode for applying a voltage across the piezoelectric element for applying a pressure on the ink in one of the pressure chambers so as to discharge ink from one of the nozzles; and a driving circuit for supplying a signal to the electrode of each actuator, wherein: the driving circuit applies, in one printing cycle, a driving signal composed of a plurality of pulse signals for bringing the actuator into resonance and discharging a plurality of ink droplets so that the ink droplets are merged together in flight; and a waveform generation frequency of the driving signal is set to be equal to a predetermined frequency at which a discharging velocity takes its peak value in an upwardly-protruding velocity curve in which the waveform generation frequency is a variable for a horizontal axis and a discharging velocity of a merged ink droplet is a variable for a vertical axis.

Note that in the present specification, the term "resonance of an actuator" means the resonance of the actuator with the pressure chamber, etc., being filled with ink. Thus, the term means the resonance of the entire vibration system including the ink, the pressure chamber forming member, etc., but not the resonance of the actuator itself, which is not filled with ink. Note that such resonance of an actuator can be determined by, for example, measuring the displacement of the actuator or measuring the ink meniscus.

Moreover, the term "waveform generation frequency" is a variable that indicates the degree of expansion/contraction when all pulse signals of a driving signal are expanded/contracted uniformly in the time axis direction, and is specifically defined as follows. Where A [MHz] denotes a fundamental frequency (note that the fundamental frequency can be set arbitrarily), and B [$\mu$s] denotes the total time of all the pulse signals of the driving signal of the fundamental frequency (specifically, the amount of time from the start of the potential transition of the first pulse to the end of the potential transition of the last pulse; hereinafter referred to as "pulse total time"), assume that the pulse total time is changed to C [$\mu$s] as all the pulse signals of the driving signal are expanded/contracted uniformly in the time axis direction. Then, the variable f [MHz] expressed as $f=A\cdot B/C$ is defined as the waveform generation frequency. As is clear from the expression, the waveform generation frequency f decreases as the pulse total time C increases, and increases as the pulse total time C decreases. In other words, the waveform generation frequency f decreases as the pulse signals are expanded along the time axis, and increases as the pulse signals are contracted along the time axis.

Thus, when the waveform generation frequency is higher than the fundamental frequency, the pulse total time C of the driving signal is shorter than the pulse total time B of a driving signal at the fundamental frequency, i.e., the driving signal is a compressed driving signal. On the other hand, where the resonance frequency of a certain actuator is lower than the resonance frequency of a reference actuator, even if the same driving signal is input to all the actuators, the driving signal of the certain actuator appears to be more compressed than the driving signal of the reference actuator. Thus, it can be said that the waveform generation frequency and the resonance frequency of an actuator are inversely related to each other.

In this ink jet recording apparatus, the waveform generation frequency of the plurality of pulse signals of the driving signal is set to be equal to a predetermined frequency at which the discharging velocity of the merged ink droplet takes its peak value. In the vicinity of the peak value, the discharging velocity does not change substantially even if the waveform generation frequency somewhat shifts. Therefore, variations in the discharging velocity can be suppressed even if there occur variations in the resonance frequency among different actuators due to manufacturing errors of the head, etc. As a result, the recording quality can be improved.

Still another ink jet recording apparatus of the present invention includes: a head body provided with a plurality of nozzles and a plurality of pressure chambers, which are communicated to the respective nozzles and are filled with ink; a plurality of actuators provided in the head body each including a piezoelectric element and an electrode for applying a voltage across the piezoelectric element for applying a pressure on the ink in one of the pressure chambers so as to discharge ink from one of the nozzles; and a driving circuit for supplying a signal to the electrode of each actuator, wherein: the driving circuit applies, in one printing cycle, a driving signal composed of a plurality of pulse signals for bringing the actuator into resonance and discharging a plurality of ink droplets so that the ink droplets are merged together in flight; and a waveform generation frequency of the driving signal is set to be equal to a predetermined frequency at which a discharged ink volume takes its peak value in an upwardly-protruding discharged ink volume curve in which the waveform generation frequency is a variable for a horizontal axis and a discharged ink volume of a merged ink droplet is a variable for a vertical axis.

In this ink jet recording apparatus, the waveform generation frequency of the plurality of pulse signals of the driving signal is set to be equal to a predetermined frequency at which the discharged ink volume of a merged ink droplet takes its peak value. In the vicinity of the peak value, the discharged ink volume does not change substantially even if the waveform generation frequency somewhat shifts. Therefore, variations in the discharged ink volume can be suppressed even if there occur variations in the resonance frequency among different actuators due to manufacturing errors of the head, etc. As a result, the recording quality can be improved.

Still another ink jet recording apparatus of the present invention includes: a head body provided with a plurality of nozzles and a plurality of pressure chambers, which are communicated to the respective nozzles and are filled with ink; a plurality of actuators provided in the head body each including a piezoelectric element and an electrode for applying a voltage across the piezoelectric element for applying a pressure on the ink in one of the pressure chambers so as to discharge ink from one of the nozzles; and a driving circuit for supplying a signal to the electrode of each actuator, wherein: the driving circuit applies, in one printing cycle, a driving signal composed of a plurality of pulse signals for bringing the actuator into resonance and discharging a plurality of ink droplets so that the ink droplets are merged together in flight; and a waveform generation frequency of the driving signal is set to be greater than a predetermined frequency at which a discharged ink volume takes its peak value in an upwardly-protruding discharged ink volume curve in which the waveform generation frequency is a variable for a horizontal axis and a discharged ink volume of a merged ink droplet is a variable for a vertical axis.

In this ink jet recording apparatus, the waveform generation frequency of the plurality of pulse signals of the driving signal is set to be greater than a predetermined frequency at which the discharged ink volume of a merged ink droplet takes its peak value. When the waveform generation frequency is greater than the predetermined frequency, the discharged ink volume of the merged ink droplet is likely to be small. On the other hand, the waveform generation frequency being greater than the predetermined frequency is equivalent to the resonance frequency of the actuator being small. Accordingly, the amount of deformation of the actuator increases. As a result, the discharged ink volume of the merged ink droplet is likely to be large. Thus, if the waveform generation frequency is greater than the predetermined frequency, the change in the discharged ink volume due to the variations in the resonance frequency of the actuator and the change in the discharged ink volume due to the variations in the amount of deformation of the actuator are canceled out by each other. Therefore, variations in the discharged ink volume can be suppressed even if there occur variations among different actuators due to manufacturing errors of the head, etc. As a result, the recording quality can be improved.

Each pulse signal of the driving signal may have a potential decreasing waveform for depressurizing the pressure chamber, a potential holding waveform for holding a potential and a potential increasing waveform for pressurizing the pressure chamber so that an ink droplet is discharged when the pressure chamber is pressurized after it is depressurized; a potential falling time of the potential decreasing waveform of the pulse signal may be set to be less than or equal to a natural period of the actuator; and a potential holding time of the potential holding waveform of the pulse signal may be set to be less than or equal to ½ of the natural period of the actuator.

Note that the term "natural period of an actuator" as used herein refers to the natural period of the entire vibration system including the ink, etc. The natural period of the actuator is equal in meaning to the Helmholtz period of the head as described above.

Thus, the printing cycle is shortened, and the head response is improved.

BRIEF DESCRIPTION OF THE DRAWINGS

FIG. 8A and FIG. 8B are graphs each illustrating the relationship between the pulse interval and the ink droplet discharging velocity, wherein FIG. 8A shows a case where the resonance period is equal to the reference resonance period, and FIG. 8B shows a case where the resonance period is greater than the reference resonance period.

FIG. 9A to FIG. 9C are graphs each illustrating the relationship between the pulse interval and the ink droplet discharging velocity, wherein FIG. 9A shows a case where the resonance period is equal to the reference resonance period, FIG. 9B shows a case where the resonance period is greater than the reference resonance period, and FIG. 9C shows a case where the resonance period is less than the reference resonance period.

DESCRIPTION OF THE PREFERRED EMBODIMENTS

Embodiments of the present invention will now be described with reference to the drawings.

Embodiment 1

Figure 1:
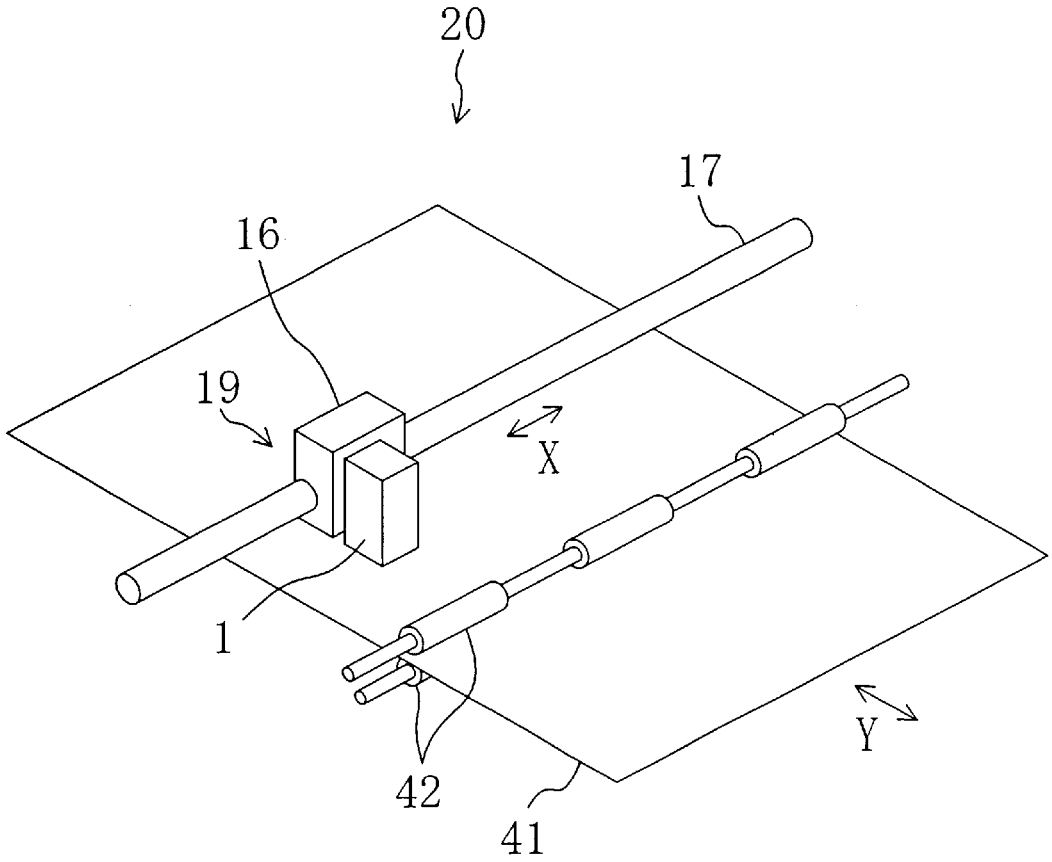
FIG. 1 is a diagram generally illustrating the configuration of a printer according to one embodiment.
Figure 2:
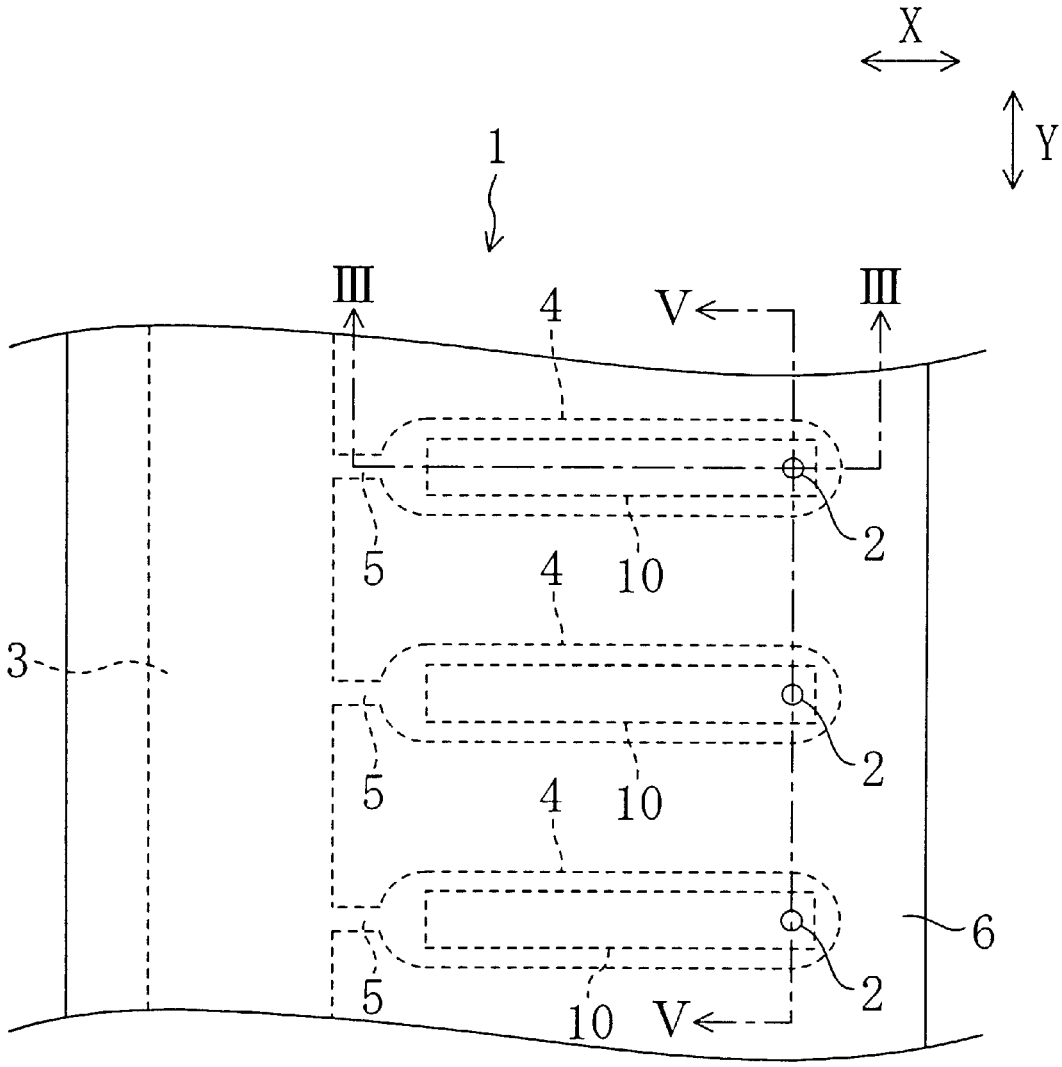
FIG. 2 is a plan view illustrating a part of an ink jet head.

FIG. 1 is a diagram generally illustrating the configuration of a printer 20 as an ink jet recording apparatus. The printer 20 includes an ink jet head 1 secured on a carriage 16. The carriage 16 is provided with a carriage motor 28 (see FIG. 6) which is not shown in FIG. 1. The carriage 16 is reciprocated by the carriage motor 28 in the primary scanning direction (the X direction as shown in FIG. 1 and FIG. 2) while being guided by a carriage shaft 17 which extends in the primary scanning direction. The ink jet head 1, being mounted on the carriage 16, is reciprocated in the primary scanning direction X as the carriage 16 reciprocates. Note that the carriage 16, the carriage shaft 17 and the carriage motor 28 together form a driving mechanism 19 for relatively moving the ink jet head 1 and recording paper 41 with respect to each other.

The recording paper 41 is sandwiched between two carrier rollers 42 which are rotated by a carrier motor 26 (see FIG. 6) which is not shown in FIG. 1, and is carried by the carrier motor 26 and the carrier rollers 42 in the secondary scanning direction (the Y direction as shown in FIG. 1 and FIG. 2) which is perpendicular to the primary scanning direction X.

As illustrated in FIG. 2 to FIG. 5, the ink jet head 1 includes: a head body 40 which is provided with a plurality of pressure chambers 4 containing ink and a plurality of nozzles 2 communicated to the pressure chambers 4, respectively; and a plurality of actuators 10 for applying a pressure on the ink in the respective pressure chambers 4. The actuators 10 are so-called "piezo type" actuators, which utilize a piezoelectric effect of piezoelectric elements 13, and are more particularly flexural vibration type actuators. The actuators 10 discharge ink droplets from the nozzles 2 and fill the ink into the pressure chambers 4 by the change of the pressure in the pressure chambers 4 caused by contraction and expansion of the pressure chambers 4.

As illustrated in FIG. 2, the pressure chambers 4 are each formed in an elongate groove shape so as to extend in the primary scanning direction X in the ink jet head 1, and are arranged with respect to each other with a predetermined interval in the secondary scanning direction Y. The nozzle 2 is provided on one end (the right end in FIG. 2 ) of each pressure chamber 4. The nozzles 2 provide openings on the lower surface of the ink jet head 1 which are arranged with respect to each other with a predetermined interval in the secondary scanning direction Y. One end of each ink supply path 5 is connected to the other end (the left end in FIG. 2) of the pressure chamber 4, and the other end of each ink supply path 5 is connected to an ink supply chamber 3 which is provided so as to extend in the secondary scanning direction Y.

Figure 3:
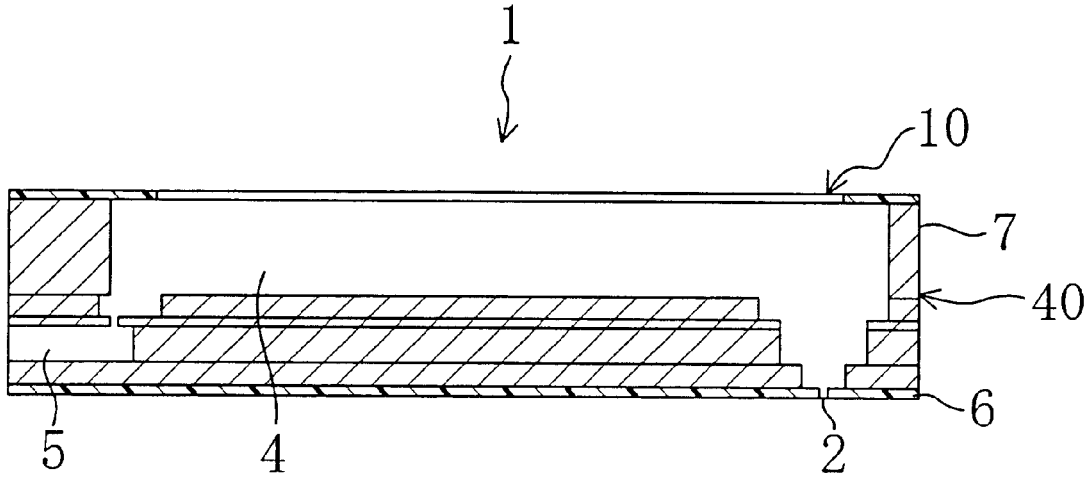
FIG. 3 is a cross-sectional view taken along line III—III of FIG. 2.

As illustrated in FIG. 3, the head body 40 includes a nozzle plate 6 in which the nozzle 2 is formed, and a partition wall 7 for partitioning the pressure chamber 4 and the ink supply path 5 from each other, which are deposited in this order. The actuator 10 is deposited on the partition wall 7. The nozzle plate 6 is a polyimide plate having a thickness of 20 $\mu$m, and the partition wall 7 is a laminate plate having a thickness of 480 $\mu$m, which is made of a stainless steel or of a stainless steel and a photosensitive glass.

Figure 4:
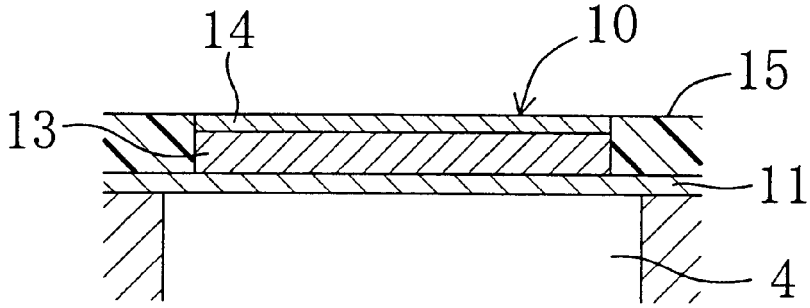
FIG. 4 is a cross-sectional view illustrating a part around an actuator.
Figure 5:
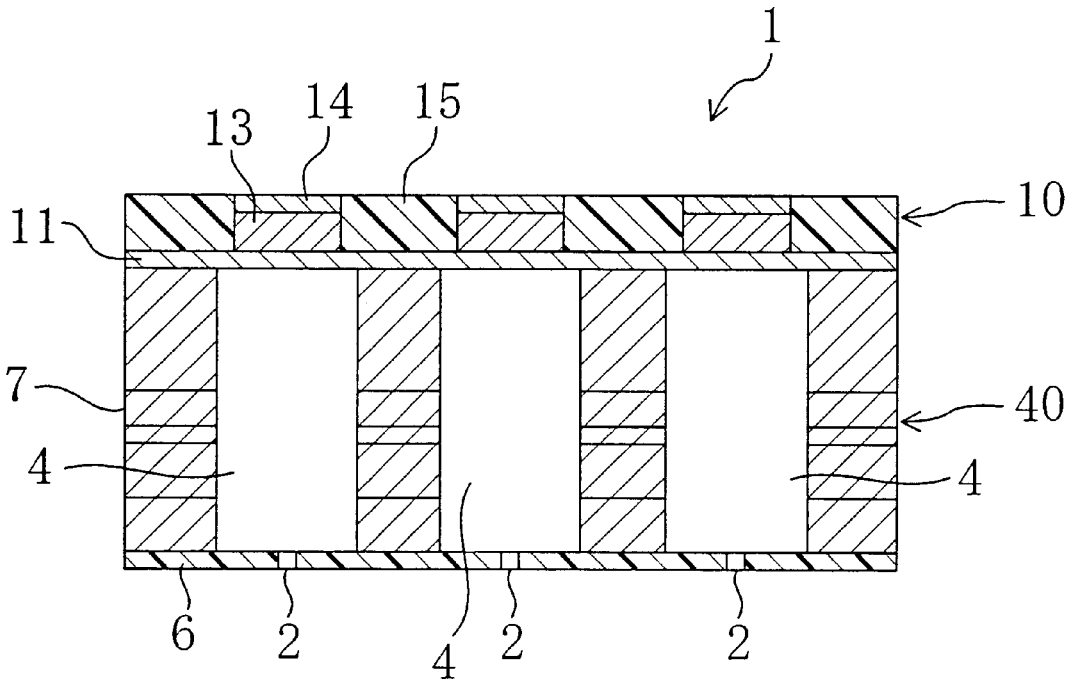
FIG. 5 is a cross-sectional view taken along line V—V of FIG. 2.

As illustrated in FIG. 4 and FIG. 5 in an exaggerated manner, the actuator 10 includes a vibration plate 11 covering the pressure chamber 4, the thin film piezoelectric element 13 for vibrating the vibration plate 11, and a separate electrode 14, which are deposited in this order. As described above, the actuator 10 is a so-called "piezoelectric actuator", which utilizes a piezoelectric effect of the piezoelectric element 13. The vibration plate 11 is a chromium plate having a thickness of 2 $\mu$m, and also functions as a common electrode which, together with the separate electrode 14, applies a voltage across the piezoelectric element 13. The piezoelectric element 13 is provided for each pressure chamber 4. A PZT (lead zirconate titanate) plate having a thickness of 0.5 $\mu$m to 5 $\mu$m can be suitably used for the piezoelectric element 13. In the present embodiment, the thickness of the piezoelectric element 13 is set to be 3 $\mu$m. The separate electrode 14 is made of a platinum plate having a thickness of 0.1 $\mu$m, and the total thickness of the actuators 10 is about 5 $\mu$m. Note that an electrically insulative layer 15 made of polyimide is provided between adjacent piezoelectric elements 13 and between adjacent separate electrodes 14.

Figure 6:
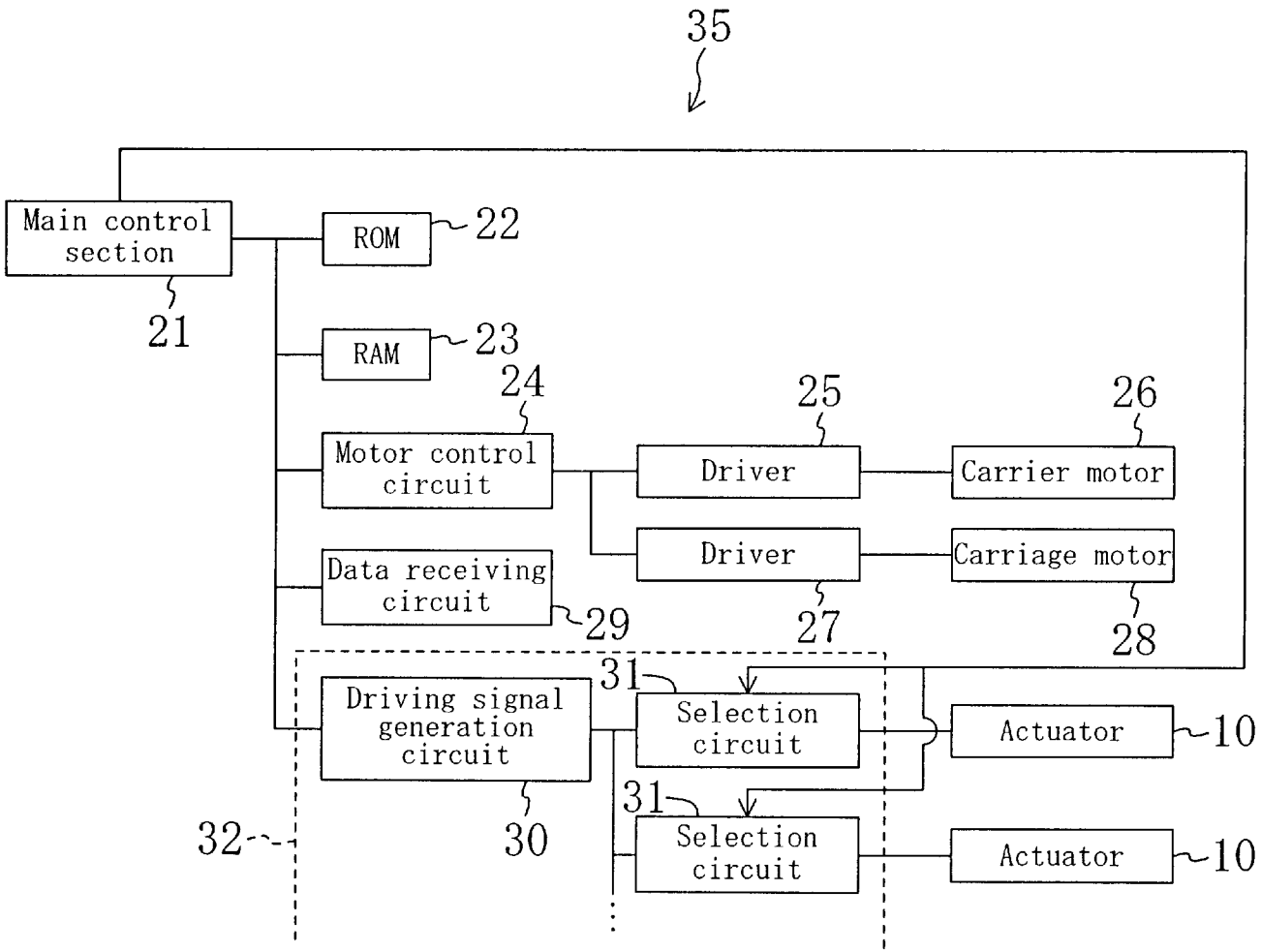
FIG. 6 is a block diagram illustrating a control circuit.

Next, a control circuit 35 of the printer 20 will be described with reference to the block diagram of FIG. 6. The control circuit 35 includes a main control section 21 comprised of a CPU, a ROM 22 storing routines for various data processing operations, etc., a RAM 23 for storing various data, etc., driver circuits 25 and 27 and a motor control circuit 24 for controlling the carrier motor 26 and the carriage motor 28, respectively, a data receiving circuit 29 for receiving print data, a driving signal generation circuit 30, and selection circuits 31. The actuators 10 are connected to the respective selection circuits 31.

The driving signal generation circuit 30 generates a driving signal including one or more pulses in one printing cycle. Note that the driving signal will be described later in greater detail. The selection circuit 31 causes one or more pulses included in the driving signal to be selectively input to the actuator 10 while the ink jet head 1 is moving in the primary scanning direction X along with the carriage 16. The driving signal generation circuit 30 and the selection circuits 31 together form a driving circuit 32 for supplying a predetermined driving signal to each actuator 10.

Next, the operation of the printer 20 will be described. First, image data is transmitted from a printer body (not shown), and the image data is received by the data receiving circuit 29. Then, the main control section 21 controls the carrier motor 26 and the carriage motor 28 via the motor control circuit 24 and the driver circuits 25 and 27, respectively, based on a processing routine stored in the ROM 22. The main control section 21 also causes the driving signal generation circuit 30 to generate a driving signal. Moreover, the main control section 21 outputs, to the selection circuit 31, information indicating which pulse signal(s) should be selected based on the image data. Then, based on the information, the selection circuit 31 selects predetermined one or more of the plurality of driving pulses and supplies the selected driving pulse(s) to the actuator 10. For example, when one ink droplet is to be discharged in one printing cycle, one pulse signal is selected, and when two ink droplets are to be discharged in one printing cycle, two pulse signals are selected. In this way, one or more ink droplets are discharged through the nozzle 2 of the ink jet head 1 in one printing cycle.

In a case where a plurality of pulses are supplied in one printing cycle, the driving signal includes one or more pulse whose pulse interval is shorter than the Helmholtz period of the head, and one or more pulse whose pulse interval is longer than the Helmholtz period. Note that the term "Helmholtz period" as used herein refers to the natural period of the entire vibration system taking into account not only the influence of ink in the nozzle 2 and the pressure chamber 4 but also the influence of the actuator 10, etc.

Next, a case where three ink droplets are discharged from the nozzle 2 in one printing cycle T will be described with reference to FIG. 7. In the present embodiment, a driving signal to be supplied to the actuator 10 includes three trapezoidal wave pulses P1 to P3, i.e., the first pulse P1, the second pulse P2 and the third pulse P3. Each of the pulses P1 to P3 is a pulse signal for driving the actuator 10 so as to once depressurize and then pressurize the pressure chamber 4. In other words, each of the pulses P1 to P3 is a signal for causing the actuator 10 to perform a pull and push operation (so-called "pull-push operation") so as to discharge an ink droplet.

The first pulse P1 is composed of a potential decreasing waveform P11 for decreasing the potential from a reference potential $V_H$ to a predetermined negative pressure potential (a potential for driving the actuator 10 so as to depressurize the pressure chamber 4) $V_L$, a peak hold waveform P12 for holding the potential at $V_L$, and a potential increasing waveform P13 for increasing the potential from $V_L$ to the reference potential $V_H$.

The second pulse P2 includes a potential holding waveform P21 for holding the reference potential $V_H$, a potential decreasing waveform P22 for decreasing the potential from the reference potential $V_H$ to the negative pressure potential $V_L$, a peak hold waveform P23 for holding the potential at $V_L$, and a potential increasing waveform P24 for increasing the potential from $V_L$ to the reference potential $V_H$.

The third pulse P3 includes a potential holding waveform P31 for holding the reference potential $V_H$, a potential decreasing waveform P32 for decreasing the potential from the reference potential $V_H$ to the negative pressure potential $V_L$, a peak hold waveform P33 for holding the potential at $V_L$, and a potential increasing waveform P34 for increasing the potential from $V_L$ to the reference potential $V_H$.

The pulse interval $t_1$ of the first pulse P1, the pulse interval $t_2$ of the second pulse P2, and the pulse interval $t_3$ of the third pulse P3 are set so as to satisfy:

$$t_1<t_3<t_0 \text{ and } t_2>t_0$$

where $t_0$ is the Helmholtz period of the head. Thus, the pulse intervals of the first pulse P1, the second pulse P2 and the third pulse P3 are shorter, longer and shorter, respectively, than the Helmholtz period $t_0$.

Moreover, the first pulse P1, the second pulse P2 and the third pulse P3 are arranged in an order such that the absolute value of the difference between the pulse interval thereof and the Helmholtz period $t_0$ gradually decreases, whereby a later discharged ink droplet is discharged with a higher velocity than that of a previously discharged ink droplet. Thus, the relationship D1>D2>D3 holds where D1=$|t_1-t_0|$, D2=$|t_2-t_0|$ and D3=$|t_3-t_0|$. Note however that the relationship among D1 to D3 is not limited to this as long as the first to third ink droplets can be merged together in flight.

Note that the pulse interval $t_1$ of the first pulse P1 is defined as a double length between the start of the potential decreasing waveform P11 and the end of the potential increasing waveform P13. The pulse interval $t_2$ of the second pulse P2 is defined between the start of the potential holding waveform P21 and the end of the potential increasing waveform P24. Moreover, the pulse interval $t_3$ of the third pulse P3 is defined between the start of the potential holding waveform P31 and the end of the potential increasing waveform P34. Thus, the pulse interval of the first pulse in one printing cycle is defined as a double length between the start of a potential decreasing waveform and the end of a potential increasing waveform, and the pulse interval of each of the second and subsequent pulses is defined between the start of a potential holding waveform and the end of a potential increasing waveform.

The potential holding waveform P21 of the second pulse P2 and the potential holding waveform P31 of the third pulse P3 are each set to have an interval that is ¼ to ½ of the Helmholtz period $t_0$.

When the driving signal is supplied to the actuator 10, the first ink droplet is first discharged by the first pulse P1. Then, the second pulse P2 is applied, whereby the second ink droplet is discharged with a discharging velocity v2 that is greater than the discharging velocity v1 of the first ink droplet due to the resonance of the ink meniscus vibration. Then, the third pulse P3 is applied, whereby the third ink droplet is discharged with a discharging velocity v3 that is greater than the discharging velocity v2 of the second ink droplet. Thus, the first to third ink droplets are discharged with successively increasing discharging velocities (v1<v2<v3), whereby the first to third ink droplets are merged together in flight into a single ink droplet before landing on the recording paper 41. In this way, even in the case of high-speed printing, a desirable ink dot is formed, preventing the ink dot from being formed in an oblong circular shape.

With regard to the pressure chambers 4, the actuators 10, etc., a slight dimensional error, etc., may occur during the manufacturing process. The characteristics of the actuators 10 may slightly change also due to a change in the environmental temperature, a deterioration over time, etc. Therefore, it is difficult to maintain a high degree of uniformity among all the pressure chambers 4, actuators 10, etc., included in the ink jet head, and the Helmholtz period may slightly vary among different nozzles. Specifically, there may occur a slight difference between the Helmholtz period, which has been predetermined during the design process, etc., (hereinafter referred to as "reference resonance period") and the actual resonance period, whereby the actual resonance period varies among different nozzles.

According to the present embodiment, however, the driving signal includes, in one printing cycle, a pulse whose pulse interval is shorter than the reference resonance period and a pulse whose pulse interval is longer than the reference resonance period. Therefore, even if the nozzle characteristics vary among different nozzles, the variations in the ink droplet discharging velocity among different nozzles are reduced, for reasons to be described below with reference to FIG. 8A to FIG. 9C.

Figure 8A:
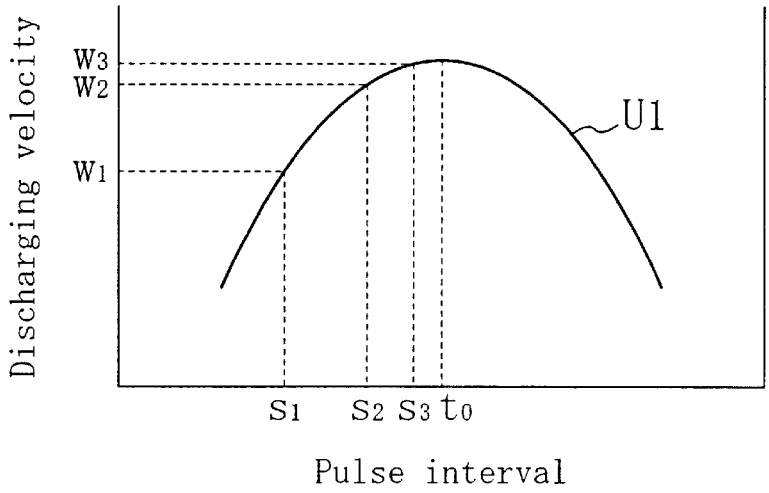

FIG. 8A, FIG. 8B, FIG. 9A, FIG. 9B and FIG. 9C each illustrate the relationship between the pulse interval and the ink droplet discharging velocity. FIG. 8A shows a case where all of the pulse intervals $s_1$ to $s_3$ of the first to third pulses P1 to P3 are shorter than the reference resonance period $t_0$. Even then, if the pulse intervals $s_1$ to $s_3$ of the first to third pulses P1 to P3 are set so as to be successively closer to the reference resonance period $t_0$, the discharging velocities $w_1$ to $w_3$ of the first to third ink droplets discharged by the first to third pulses P1 to P3 will be successively greater (i.e., $w_1<w_2<w_3$). Thus, the ink droplets can be merged together in flight.

Figure 8B:
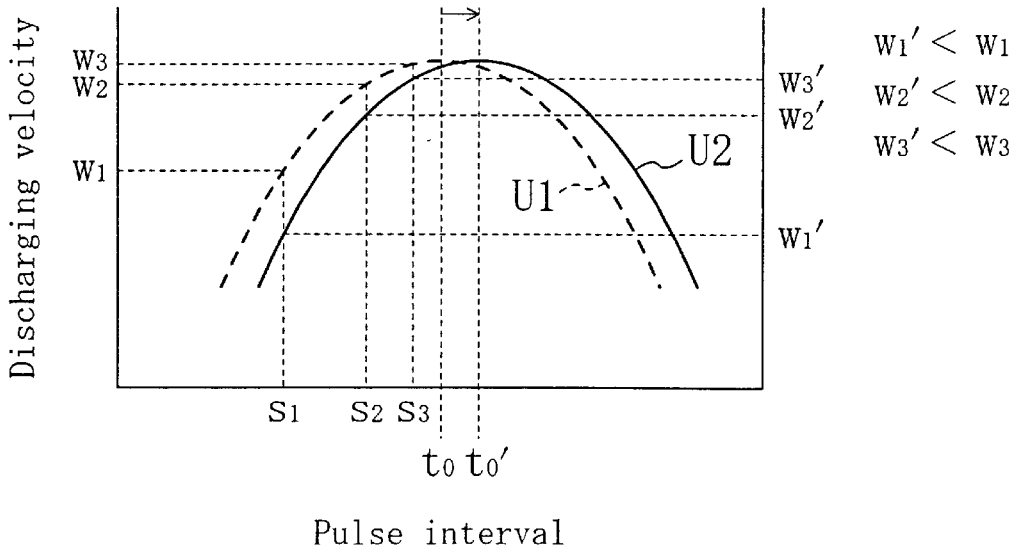

FIG. 8B shows a case where the Helmholtz period shifts to be longer (from $t_0$ to $t_0'$) due to a change in the characteristics of the actuator 10, etc., whereby the actuator characteristics curve transitions from the broken line curve U1 to the solid line curve U2. In such a case, the discharging velocities of the ink droplets discharged by the first to third pulses P1 to P3 are smaller than the respective reference discharging velocities. Thus, the discharging velocity $w_1'$ of the ink droplet discharged by the first pulse P1 having the pulse interval $s_1$ is less than the reference discharging velocity $w_1$. Moreover, the discharging velocity $w_2'$ of the ink droplet discharged by the second pulse P2 having the pulse interval $s_2$ is less than the reference discharging velocity $w_2$. Similarly, the discharging velocity $w_3'$ of the ink droplet discharged by the third pulse P3 having the pulse interval $s_3$ is less than the reference discharging velocity $w_3$. As the discharging velocities for the first to third ink droplets all decrease, the discharging velocity of the merged ink droplet will be considerably less than the reference discharging velocity thereof Thus, the ink droplet landing position is likely to be shifted.

Figure 9A:
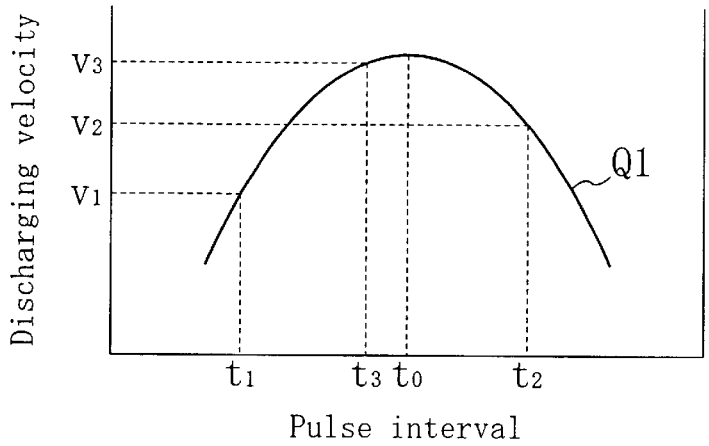

In contrast, according to the present embodiment, the plurality of pulses to be applied in one printing cycle include a pulse applied with an interval shorter than the reference resonance period $t_0$ and a pulse applied with an interval longer than the reference resonance period $t_0$, as illustrated in FIG. 9A.

Figure 9B:
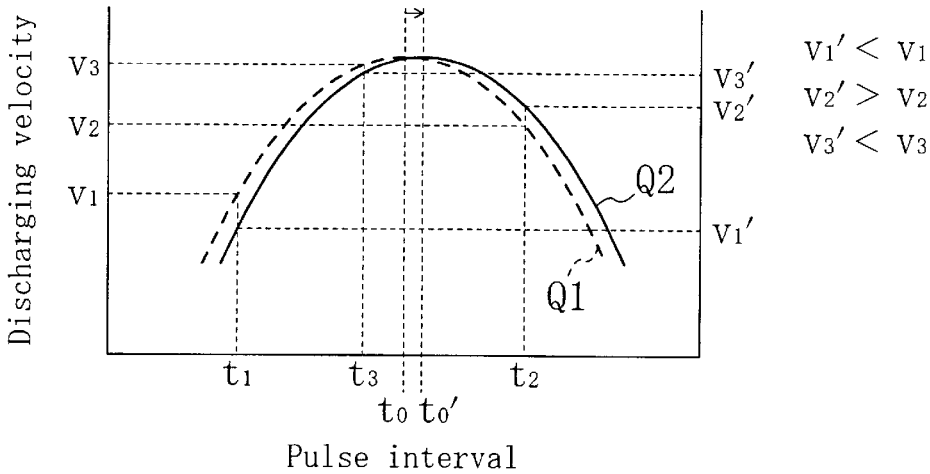

If the Helmholtz period shifts to be longer (from $t_0$ to $t_0'$), the characteristics curve transitions from the curve Q1 to the curve Q2, as illustrated in FIG. 9B. In such a case, an ink droplet discharged by a pulse whose pulse interval is shorter than reference resonance period $t_0$ is discharged with a velocity less than the reference discharging velocity thereof. However, an ink droplet discharged by a pulse whose pulse interval is longer than the reference resonance period $t_0$ is discharged with a velocity greater than the reference discharging velocity thereof Specifically, the discharging velocity $v_1'$ of the first ink droplet is less than the reference discharging velocity $v_1$ thereof, the discharging velocity $v_2'$ of the second ink droplet is greater than the reference discharging velocity $v_2$ thereof, and the discharging velocity $v_3'$ of the third ink droplet is less than the reference discharging velocity $v_3$ thereof.

Figure 9C:
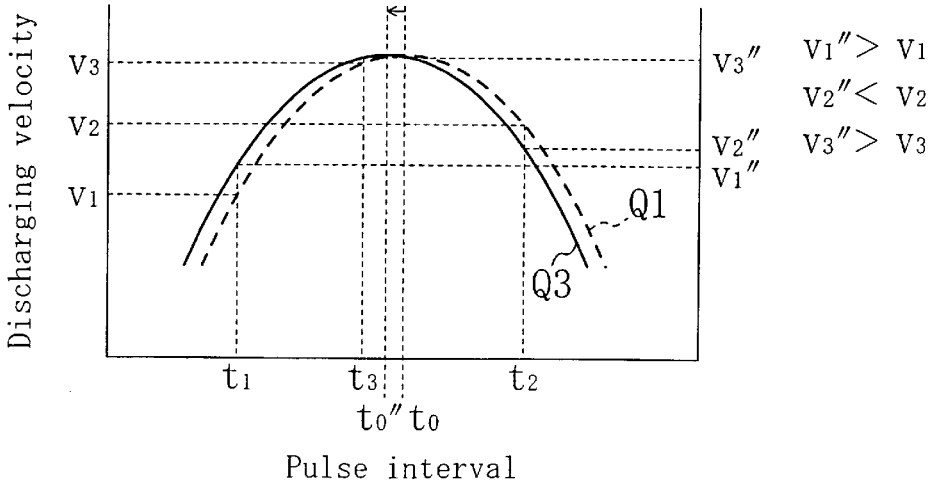

On the other hand, if the Helmholtz period shifts to be shorter (from $t_0$ to $t_0''$), the characteristics curve transitions from the curve Q1 to the curve Q3, as illustrated in FIG. 9C. In such a case, an ink droplet discharged by a pulse whose pulse interval is shorter than reference resonance period $t_0$ is discharged with a velocity greater than the reference discharging velocity thereof. On the other hand, an ink droplet discharged by a pulse whose pulse interval is longer than the reference resonance period $t_0$ is discharged with a velocity less than the reference discharging velocity thereof. Specifically, the discharging velocity $v_1''$ of the first ink droplet is greater than the reference discharging velocity $v_1$ thereof, the discharging velocity $v_2''$ of the second ink droplet is less than the reference discharging velocity $v_2$ thereof, and the discharging velocity $v_3''$ of the third ink droplet is greater than the reference discharging velocity $v_3$ thereof.

Therefore, according to the present embodiment, whether the Helmholtz period shifts to be longer or shorter, the shift component that decreases the ink droplet discharging velocity and the shift component that increases the ink droplet discharging velocity are canceled out by each other to some degree. In this way, the variations in the discharging velocity of a merged ink droplet are suppressed, as compared with a case where the respective discharging velocities of the ink droplets are all greater than the reference discharging velocity or all less than the reference discharging velocity. Thus, the shift in the landing position in the scanning direction X is reduced for a merged ink droplet.

Therefore, even if the Helmholtz period varies among different nozzles, it is possible to suppress the variations in the ink droplet landing position. Thus, it is possible to improve the recording quality, e.g., it is possible to prevent the occurrence of a white streak in a solid print.

Note that in the present embodiment, the pulses P1 to P3 whose pulse intervals are shorter, longer and shorter, respectively, than the reference resonance period are applied in this order in one printing cycle. Alternatively, three pulses whose pulse intervals are longer, shorter and longer (or shorter, shorter and longer; longer, shorter and shorter; longer, longer and shorter; or shorter, longer and longer), respectively, than the reference resonance period may be applied in this order in one printing cycle.

Even if the last one or more of the plurality of pulses applied in one printing cycle has a pulse interval equal to the reference resonance period, the ink droplets can be discharged with successively increasing discharging velocities. Specifically, the pulse interval $t_3$ of the third pulse P3 may be equal to the reference resonance period $t_0$. Alternatively, the pulse interval $t_2$ of the second pulse P2 and the pulse interval $t_3$ of the third pulse P3 may be both equal to the reference resonance period $t_0$, i.e., $$t_1 < t_3 \leqq t_0 \text{ and } t_2 \geqq t_0.$$

One or more of a plurality of pulses may have an equal pulse interval.

EXAMPLES

Next, two examples will be described.

Example 1

Figure 7:
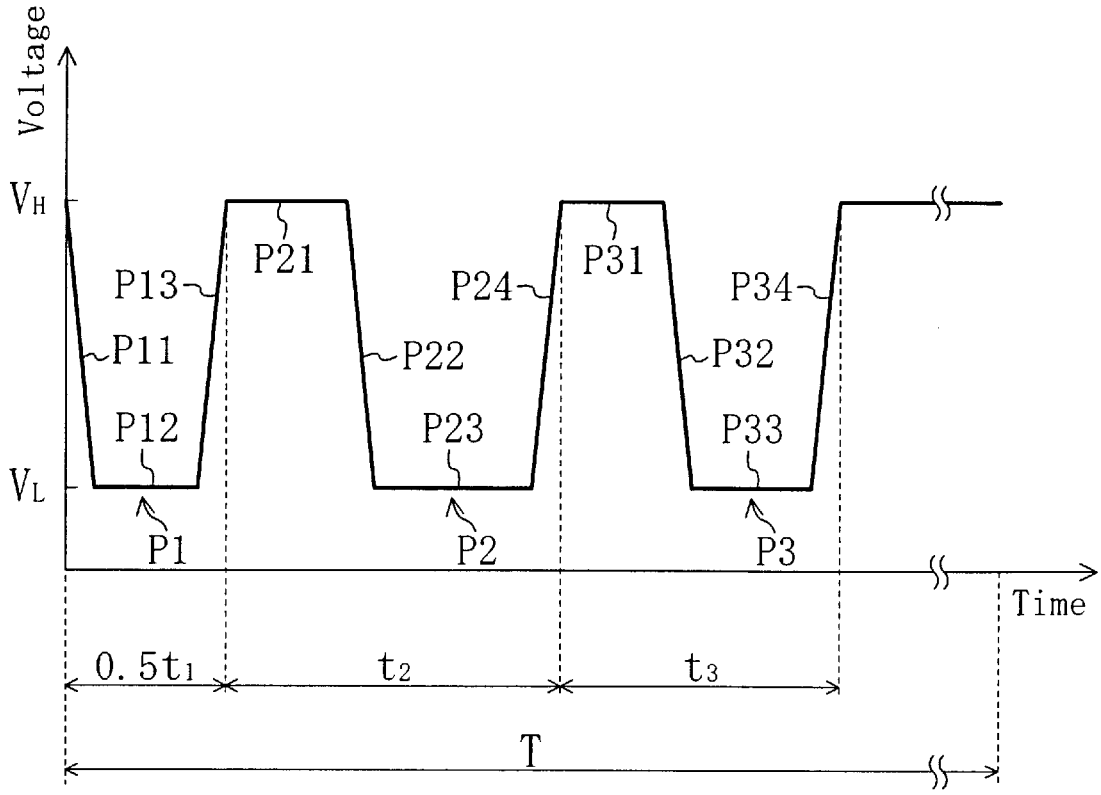
FIG. 7 is a waveform diagram illustrating a driving signal according to Embodiment 1.

In the present example, the driving signal supplied in one printing cycle T includes three pulses, as illustrated in FIG. 7. The reference voltage $V_H$, the negative pressure voltage $V_L$, the pulse interval $t_1$ of the first pulse P1, the pulse interval $t_2$ of the second pulse P2 and the pulse interval $t_3$ of the third pulse P3 are set to values as shown in Tables 1 and 2 below. In the present example, the reference resonance period is set to be 8 $\mu$s.

Note that in Tables 1 to 3, the parameter "S" represents a pulse whose pulse interval is shorter than the reference resonance period, and the parameter "L" represents a pulse whose pulse interval is longer than the reference resonance period. Table 1 and Table 3 also show comparative examples where the driving signal is composed only of pulses whose pulse intervals are shorter than the reference resonance period.

TABLE 1

| Parameter | SSS | $\lvert t_n-t_0\rvert$ | SLS | $\lvert t_n-t_0\rvert$ | SSL | $\lvert t_n-t_0\rvert$ | LSS | $\lvert t_n-t_0\rvert$ |
|---|---|---|---|---|---|---|---|---|
| VH | | | | 26 V | | | | |
| VL | | | | 0 V | | | | |
| $t_1$ | 5 $\mu$s | 3 $\mu$s | 5 $\mu$s | 3 $\mu$s | 5 $\mu$s | 3 $\mu$s | 10 $\mu$s | 2 $\mu$s |
| $t_2$ | 6 $\mu$s | 2 $\mu$s | 9.5 $\mu$s | 1.5 $\mu$s | 6 $\mu$s | 2 $\mu$s | 6 $\mu$s | 2 $\mu$s |

TABLE 1-continued

| Parameter | SSS | $\lvert t_n-t_0\rvert$ | SLS | $\lvert t_n-t_0\rvert$ | SSL | $\lvert t_n-t_0\rvert$ | LSS | $\lvert t_n-t_0\rvert$ |
|---|---|---|---|---|---|---|---|---|
| $t_3$ | 6.5 μs | 1.5 μs | 6.5 μs | 1.5 μs | 8.5 μs | 0.5 μs | 6.5 μs | 1.5 μs |

$t_0$ = 8 μs, n = 1, 2, 3
S: short pulse interval, L: long pulse interval

TABLE 2

| Parameter | LSL | $\lvert t_n-t_0\rvert$ | LLS | $\lvert t_n-t_0\rvert$ | SLL | $\lvert t_n-t_0\rvert$ |
|---|---|---|---|---|---|---|
| $V_H$ | | | 26 V | | | |
| $V_L$ | | | 0 V | | | |
| $t_1$ | 10 μs | 2 μs | 10 μs | 2 μs | 5 μs | 3 μs |
| $t_2$ | 6 μs | 2 μs | 8.5 μs | 0.5 μs | 9 μs | 1 μs |
| $t_3$ | 8.5 μs | 0.5 μs | 7.5 μs | 0.5 μs | 8.5 μs | 0.5 μs |

$t_0$ = 8 μs, n = 1, 2, 3
S: short pulse interval, L: long pulse interval

Table 3 below shows the measurement results of ink droplet discharging velocities V1, V2, V3 and VM of the first, second, third and merged ink droplets, respectively, for the Helmholtz period $t_0$ (columns labeled "$t_0$") for the various parameter sets shown in Tables 1 and 2, in comparison with those after the Helmholtz period $t_0$ is shifted to be longer by 3.75% (columns labeled "+3.75%").

TABLE 3

| | SSS | | | SLS | | | SSL | | | LSS | | |
|---|---|---|---|---|---|---|---|---|---|---|---|---|
| | $t_0$ | | +3.75% | $t_0$ | | +3.75% | $t_0$ | | +3.75% | $t_0$ | | +3.75% |
| V1 | 2.8 m/s | > | 2.4 m/s | 2.8 m/s | > | 2.4 m/s | 2.8 m/s | > | 2.4 m/s | 5.2 m/s | < | 5.6 m/s |
| V2 | 5.2 m/s | > | 5.1 m/s | 8.0 m/s | < | 8.4 m/s | 5.2 m/s | > | 5.1 m/s | 8.3 m/s | ≧ | 8.3 m/s |
| V3 | 8.9 m/s | > | 7.0 m/s | 11.3 m/s | > | 10.7 m/s | 10.1 m/s | < | 11.9 m/s | 12.7 m/s | > | 12.0 m/s |
| VM | 6.4 m/s | | 5.4 m/s (−16%) | 8.9 m/s | | 8.8 m/s (−1%) | 6.9 m/s | | 7.7 m/s (+12%) | 9.5 m/s | | 9.3 m/s (−2%) |

| | LSL | | | LLS | | | SLL | | |
|---|---|---|---|---|---|---|---|---|---|
| | $t_0$ | | +3.75% | $t_0$ | | +3.75% | $t_0$ | | +3.75% |
| V1 | 5.2 m/s | < | 5.6 m/s | 5.2 m/s | < | 5.6 m/s | 2.8 m/s | > | 2.4 m/s |
| V2 | 8.3 m/s | ≧ | 8.3 m/s | 8.4 m/s | < | 9.4 m/s | 8.0 m/s | < | 8.4 m/s |
| V3 | 14.5 m/s | ≦ | 14.5 m/s | 10.5 m/s | > | 10.0 m/s | 9.9 m/s | < | 12.0 m/s |
| VM | 10.2 m/s | | 10.2 m/s (0%) | 8.5 m/s | | 9.2 m/s (+8%) | 8.3 m/s | | 9.1 m/s (+10%) |

It can be seen from Table 3 that the shift in the merged ink droplet discharging velocity occurring when the Helmholtz period is shifted to be longer is suppressed when the pulse intervals $t_1$ to $t_3$ of the first to third pulses P1 to P3 include a pulse interval shorter than the reference resonance period and a pulse interval longer than the reference resonance period, as compared to when the pulse intervals $t_1$ to $t_3$ are all shorter than the reference resonance period.

Example 2

Figure 10:
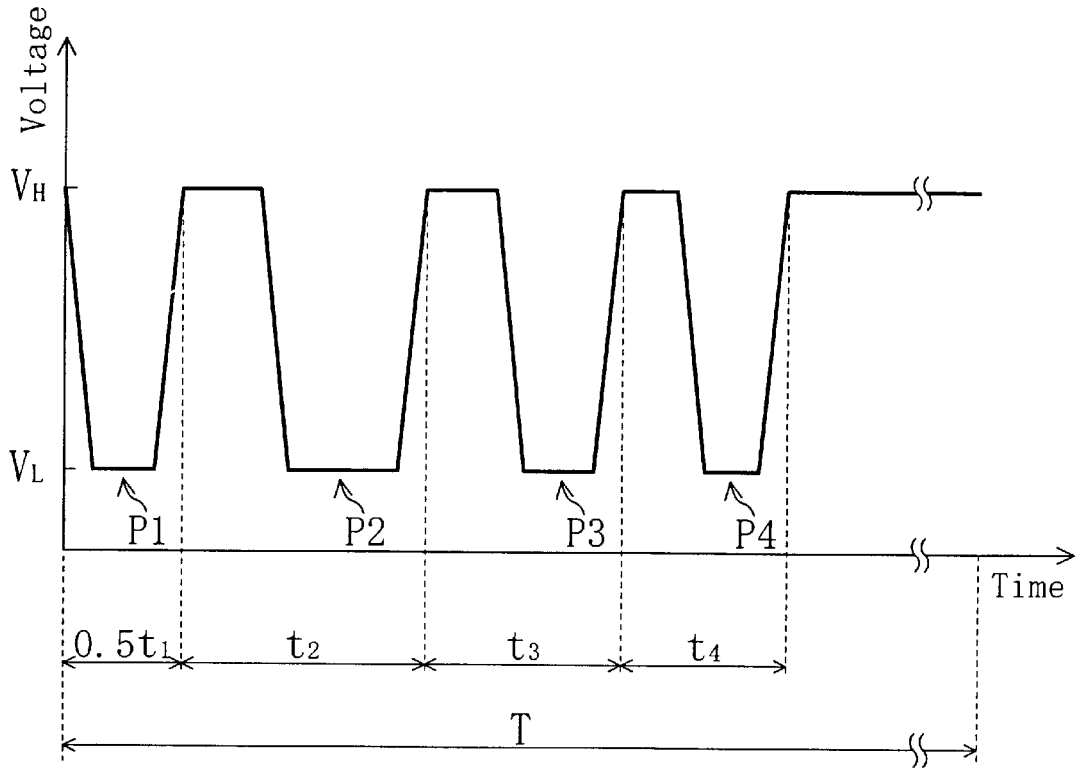
FIG. 10 is a waveform diagram illustrating a driving signal according to an example of Embodiment 1.

In the present example, the driving signal supplied in one printing cycle T includes four pulses, as illustrated in FIG. 10. The reference voltage $V_H$, the negative pressure voltage $V_L$, the pulse interval $t_1$ of the first pulse P1, the pulse interval $t_2$ of the second pulse P2, the pulse interval $t_3$ of the third pulse P3 and the pulse interval $t_4$ of the fourth pulse P4 are set to values as shown in Table 4 below. Note that in the present example, the reference resonance period is set to be 8 μs.

TABLE 4

| Parameter | Value |
|---|---|
| $V_H$ | 26 V |
| $V_L$ | 0 V |
| $t_1$ | 13 μs |
| $t_2$ | 9 μs |
| $t_3$ | 8.5 μs |
| $t_4$ | 7.5 μs |

Thus, in the present example, the four pulses P1, P2, P3 and P4 whose pulse intervals are longer, longer, longer and shorter, respectively, than the reference resonance period are applied.

Figure 11:
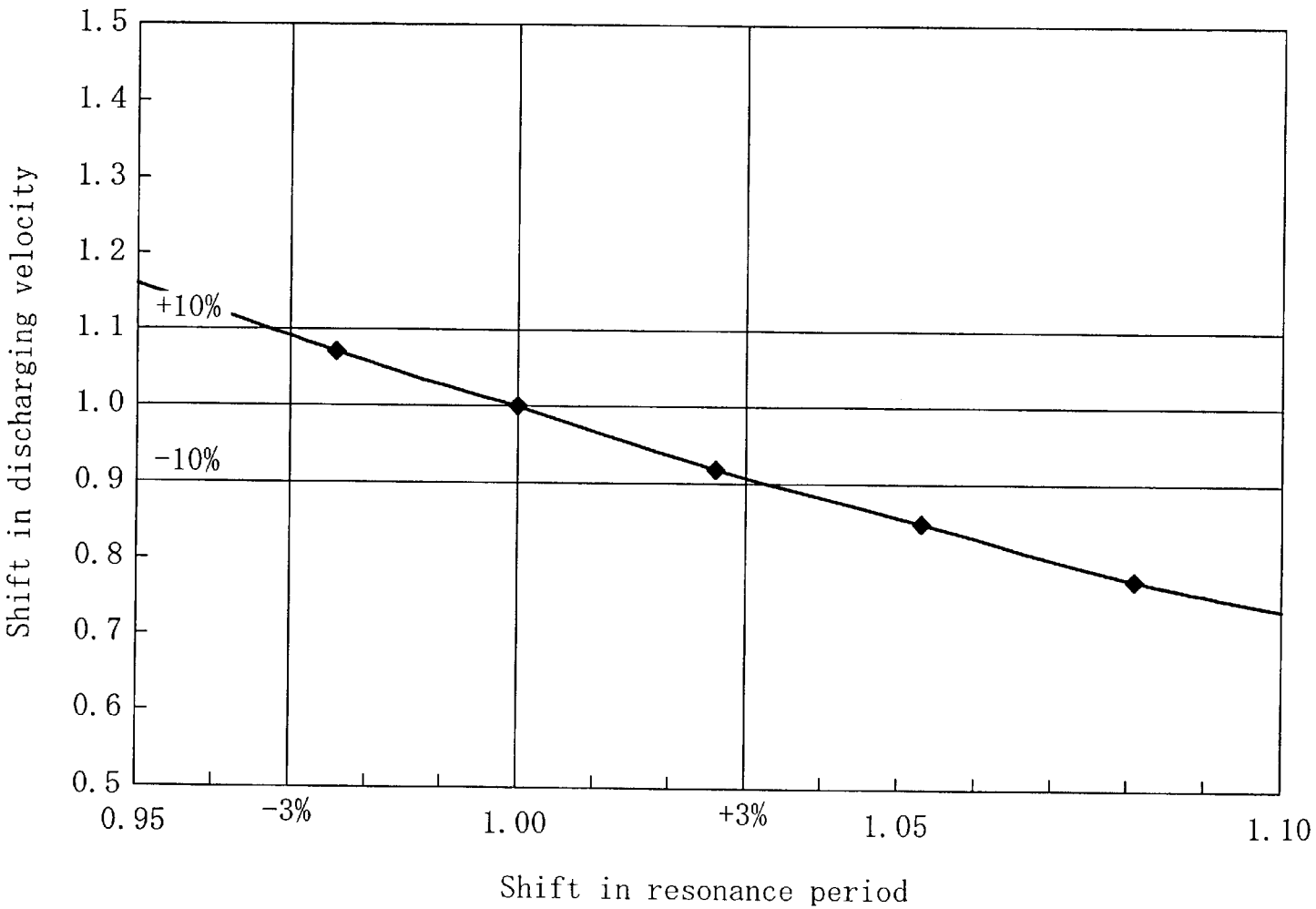
FIG. 11 is a graph illustrating the proportion by which the ink droplet discharging velocity shifts in response to a shift in the resonance period.

Proportion by which Discharging Velocity Shifts in Response to Shift in Resonance Period FIG. 11 is a graph showing the proportion by which the ink droplet discharging velocity shifts in response to a shift in the Helmholtz period. The horizontal axis represents the proportion of the resonance period with respect to the reference resonance period, and the vertical axis represents the proportion of the discharging velocity with respect to the discharging velocity (reference discharging velocity) at the reference resonance period. It can be seen from FIG. 11 that the shift in the ink droplet discharging velocity can be suppressed within a ±10% range if the shift in the resonance period is within ±3%.

Embodiment 2

In Embodiment 1, an interval equal to the Helmholtz period of the head is used as the reference pulse interval, with which the ink droplet discharging velocity is maximized. However, with an actual ink jet head 1, there are various uncertainties such as the interference between adjacent actuators 10. Therefore, the pulse interval that actually maximizes the ink droplet discharging velocity may be a predetermined interval that is slightly shifted from the Helmholtz period.

In view of this, Embodiment 2 uses a predetermined pulse interval that actually maximizes the ink droplet discharging velocity as a reference, and a pulse whose pulse interval is shorter than the predetermined pulse interval and a pulse whose pulse interval is longer than the predetermined pulse interval are included in the set of pulses to be applied in one printing cycle.

The predetermined pulse interval that actually maximizes the ink droplet discharging velocity can be uniquely determined in advance by an experiment, etc.

In the present embodiment, as in Embodiment 1, even if the resonance period varies among different actuators, it is possible to suppress the variations in the ink droplet landing position, and to improve the recording quality.

Embodiment 3

Figure 12:
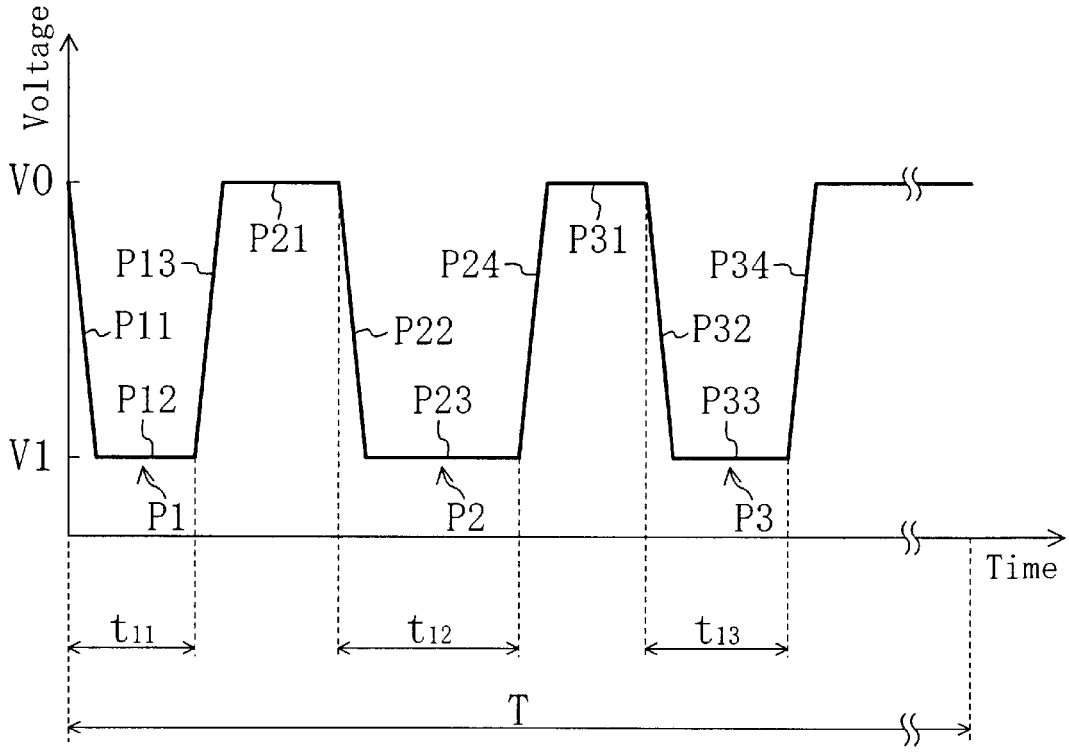
FIG. 12 is a waveform diagram illustrating a driving signal according to Embodiment 3.

In Embodiment 3, the driving signal supplied in one printing cycle T includes a pulse signal whose pulse width is shorter than one half of the Helmholtz period and a pulse signal whose pulse width is longer than one half of the Helmholtz period, as illustrated in FIG. 12.

Also in the present embodiment, the first to third pulses P1 to P3 are supplied in one printing cycle T. Herein, "pulse width" of a pulse is defined between the start of the potential decreasing waveform of the pulse and the end of the peak hold waveform. The pulse width $t_{11}$ of the first pulse P1, the pulse width $t_{12}$ of the second pulse P2 and the pulse width $t_{13}$ of the third pulse P3 are set so as to satisfy:

$$t_{11}<t_{13}\leqq 0.5t_0 \text{ and } t_{12}>0.5t_0,$$

where $t_0$ is the Helmholtz period $t_0$ be the reference. Thus, the pulse widths of the first to third pulses P1 to P3 are shorter, longer and shorter, respectively, than the half period $t_f=0.5t_0$, i.e., one half of the reference resonance period $t_0$.

Moreover, the first to third pulses P1 to P3 are arranged in an order such that the absolute value of the difference between the pulse width thereof and the half period $t_f$ gradually decreases, whereby a later discharged ink droplet is discharged with a higher velocity than that of a previously discharged ink droplet. Thus, the relationship D11>D12>D13 holds where D11=$|t_{11}-t_f|$, D12=$|t_{12}-t_f|$ and D13=$|t_{13}-t_f|$. Note however that the relationship among D11 to D13 is not limited to this as long as the first to third ink droplets can be merged together in flight.

The potential holding waveform P21 of the second pulse P2 and the potential holding waveform P31 of the third pulse P3 are each set to have an interval that is ¼ to ½ of the reference resonance period $t_0$.

Also in the present embodiment, as the first to third pulses P1 to P3 are applied, the first to third ink droplets are discharged and are merged together in flight into a single ink droplet before landing on the recording paper 41.

As described above, in the present embodiment, the pulses P1 and P3 whose pulse widths are shorter than the half period $t_f$ of the Helmholtz period $t_0$ to be the reference, and the second pulse P2 whose pulse width is longer than the half period $t_f$, are supplied in one printing cycle. Therefore, even if the resonance period shifts due to characteristics variations among different actuators, the shift component that decreases the ink droplet discharging velocity and the shift component that increases the ink droplet discharging velocity are canceled out by each other. Thus, also in the present embodiment, it is possible to suppress the variations in the merged ink droplet landing position and to improve the printing quality.

Note that in the present embodiment, the pulses P1 to P3 whose pulse widths are shorter, longer and shorter, respectively, than the half period $t_f$ are applied in this order in one printing cycle. Alternatively, three pulses whose pulse widths are longer, shorter and longer (or shorter, shorter and longer; longer, shorter and shorter; longer, longer and shorter; or shorter, longer and longer), respectively, than the half period $t_f$ may be applied in this order in one printing cycle.

Even if the last one or more of the plurality of pulses applied in one printing cycle has a pulse width equal to the half period $t_f$, the ink droplets can be discharged with successively increasing discharging velocities. Specifically, the pulse width $t_{13}$ of the third pulse P3 may be equal to the half period $t_f$. Alternatively, the pulse width $t_{12}$ of the second pulse P2 and the pulse width $t_{13}$ of the third pulse P3 may be both equal to the half period $t_f$, i.e., $$t_{11}<t_{13}\leqq t_f \text{ and } t_{12}\geqq t_f.$$

EXAMPLES

Next, an example will be described.

Example 3

In the present example, the driving signal supplied in one printing cycle T includes three pulses, as illustrated in FIG. 12. The reference voltage $V_H$, the negative pressure voltage $V_L$, the pulse width $t_{11}$ of the first pulse P1, the pulse width $t_{12}$ of the second pulse P2 and the pulse width $t_{13}$ of the third pulse P3 are set to values as shown in Tables 5 and 6 below. Note that in the present example, the reference resonance period is set to be 8 μs.

TABLE 5

| Parameter | SSS | $\lvert t_{1n}-t_f\rvert$ | SLS | $\lvert t_{1n}-t_f\rvert$ | SSL | $\lvert t_{1n}-t_f\rvert$ | LSS | $\lvert t_{1n}-t_f\rvert$ |
|---|---|---|---|---|---|---|---|---|
| $V_H$ | | | | 26 V | | | | |
| $V_L$ | | | | 0 V | | | | |
| $t_1$ | 2 μs | 2 μs | 2 μs | 2 μs | 2 μs | 2 μs | 4.5 μs | 0.5 μs |
| $t_2$ | 3.5 μs | 0.5 μs | 4.5 μs | 0.5 μs | 3.5 μs | 0.5 μs | 3.5 μs | 0.5 μs |
| $t_3$ | 4 μs | 0 μs | 4 μs | 0 μs | 4 μs | 0 μs | 4 μs | 0 μs |

$t_f$ = 4 μs, n = 1, 2, 3
S: short pulse interval, L: long pulse interval

TABLE 6

| Parameter | LSL | $\lvert t_{1n}-t_f \rvert$ | LLS | $\lvert t_{1n}-t_f \rvert$ | SLL | $\lvert t_{1n}-t_f \rvert$ |
|---|---|---|---|---|---|---|
| $V_H$ | | | 26 V | | | |
| $V_L$ | | | 0 V | | | |
| $t_1$ | 4.5 μs | 0.5 μs | 4.5 μs | 0.5 μs | 2 μs | 2 μs |
| $t_2$ | 3.5 μs | 0.5 μs | 4.5 μs | 0.5 μs | 4.5 μs | 0.5 μs |
| $t_3$ | 4.5 μs | 0.5 μs | 4 μs | 0 μs | 4.5 μs | 0.5 μs |

$t_f$ = 4 μs, n = 1, 2, 3
S: short pulse interval, L: long pulse interval

Table 7 below shows the measurement results of ink droplet discharging velocities V1, V2, V3 and VM of the first, second, third and merged ink droplets, respectively, for the Helmholtz period $t_0$ (columns labeled "$t_0$") for the various parameter sets shown in Tables 5 and 6, in comparison with those after the Helmholtz period $t_0$ is shifted to be longer by 3.75% (columns labeled "±3.75%").

TABLE 7

| | SSS | | | SLS | | | SSL | | | LSS | | |
|---|---|---|---|---|---|---|---|---|---|---|---|---|
| | $t_0$ | | +3.75% | $t_0$ | | +3.75% | $t_0$ | | +3.75% | $t_0$ | | +3.75% |
| V1 | 2.8 m/s | > | 2.4 m/s | 2.8 m/s | > | 2.4 m/s | 2.8 m/s | > | 2.4 m/s | 5.2 m/s | < | 5.6 m/s |
| V2 | 5.2 m/s | > | 5.1 m/s | 8.0 m/s | < | 8.4 m/s | 5.2 m/s | > | 5.1 m/s | 8.3 m/s | ≧ | 8.3 m/s |
| V3 | 8.9 m/s | > | 7.0 m/s | 11.3 m/s | > | 10.7 m/s | 10.1 m/s | < | 11.9 m/s | 12.7 m/s | > | 12.0 m/s |
| VM | 6.4 m/s | | 5.4 m/s (−16%) | 8.9 m/s | | 8.8 m/s (−1%) | 6.9 m/s | | 7.7 m/s (+12%) | 9.5 m/s | | 9.3 m/s (−2%) |

| | LSL | | | LLS | | | SLL | | |
|---|---|---|---|---|---|---|---|---|---|
| | $t_0$ | | +3.75% | $t_0$ | | +3.75% | $t_0$ | | +3.75% |
| V1 | 5.2 m/s | < | 5.6 m/s | 5.2 m/s | < | 5.6 m/s | 2.8 m/s | > | 2.4 m/s |
| V2 | 8.3 m/s | ≦ | 8.3 m/s | 8.4 m/s | < | 9.4 m/s | 8.0 m/s | < | 8.4 m/s |
| V3 | 14.5 m/s | ≦ | 14.5 m/s | 10.5 m/s | > | 10.0 m/s | 9.9 m/s | < | 12.0 m/s |
| VM | 10.2 m/s | | 10.2 m/s (0%) | 8.5 m/s | | 9.2 m/s (+8%) | 8.3 m/s | | 9.1 m/s (+10%) |

It can be seen from Table 7 that the shift in the merged ink droplet discharging velocity occurring when the Helmholtz period is shifted to be longer is suppressed when the pulse widths $t_{11}$ to $t_{13}$ of the first to third pulses P1 to P3 include a pulse width shorter than the half period $t_f$ and a pulse width longer than the half period $t_f$, as compared to when the pulse widths $t_{11}$ to $t_{13}$ are all shorter than the half period $t_f$.

Embodiment 4

In Embodiment 3, the half period $t_f$, which is one half of the Helmholtz period $t_0$ of the head, is used as the pulse width, with which the ink droplet discharging velocity is maximized. However, with an actual ink jet head 1, the pulse width that actually maximizes the ink droplet discharging velocity may be slightly shifted from the half period $t_f$.

In view of this, Embodiment 4 uses a predetermined pulse width that actually maximizes the ink droplet discharging velocity as a reference, and a pulse whose pulse width is shorter than the predetermined pulse width and a pulse whose pulse width is longer than the predetermined pulse width are included in the set of pulses to be applied in one printing cycle.

Note that the predetermined pulse width that actually maximizes the ink droplet discharging velocity can be uniquely determined in advance by an experiment, etc.

In the present embodiment, as in Embodiment 3, even if the Helmholtz period varies among different nozzles, it is possible to suppress the variations in the ink droplet landing position, and to improve the recording quality.

Embodiment 5

Figure 13:
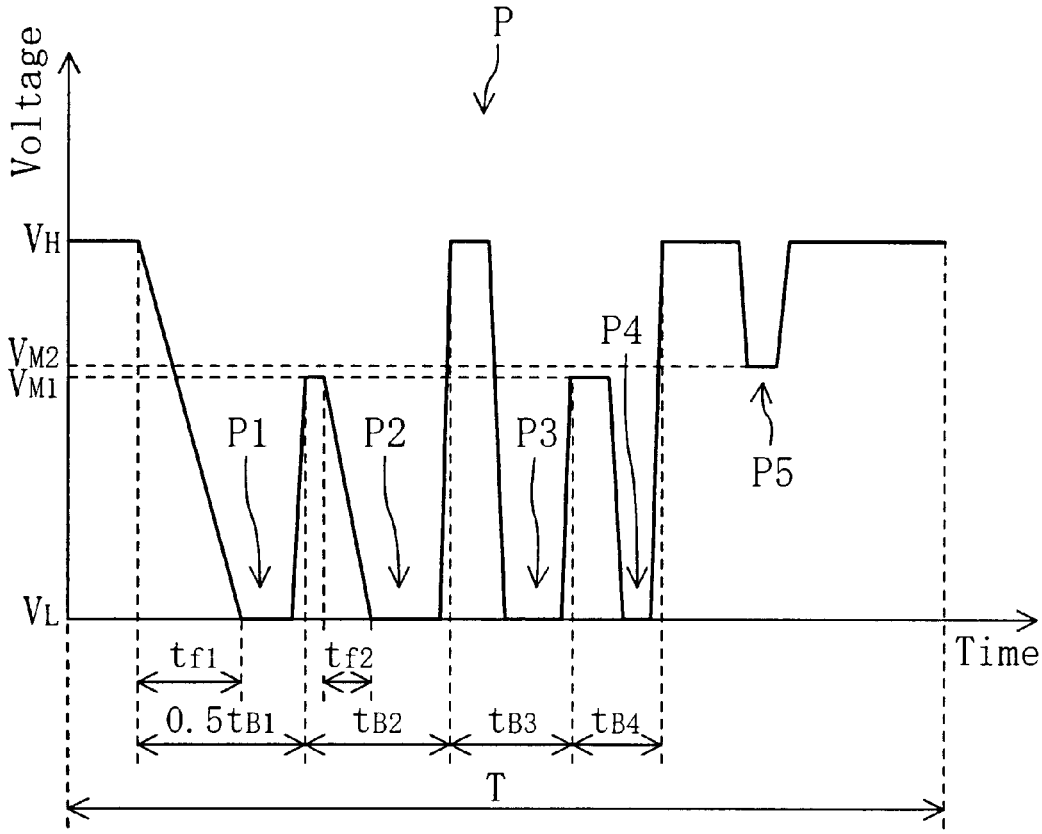
FIG. 13 is a waveform diagram illustrating a driving signal.

FIG. 13 illustrates the waveform of a driving signal P generated by the driving signal generation circuit 30. The driving signal P includes first to fourth ink discharging pulses P1 to P4 for driving the actuator 10 so as to discharge an ink droplet, and an auxiliary pulse P5 for driving the actuator 10 to a degree such that an ink droplet is not discharged. The pulses P1 to P5 are each a pulse signal that first depressurizes, and then pressurizes, the pressure chamber 4, and is a pulse signal having a so-called "pull-push waveform". In other words, each of the pulses P1 to P5 is a signal that makes the pressure chamber 4 once expand and then contract. When the ink discharging pulses P1 to P4 are supplied, ink is discharged from the nozzle 2 as the pressure chamber 4 contracts.

Specifically, the first ink discharging pulse P1 is composed of a potential decreasing waveform for decreasing the potential from the reference potential $V_H$ to a predetermined potential (hereinafter referred to as "negative pressure potential") $V_L$ at which the pressure chamber 4 is depressurized, a potential holding waveform for holding the negative pressure potential $V_L$, and a potential increasing waveform for increasing the potential from the negative pressure potential $V_L$ to a first intermediate potential $V_{M1}$. The second ink discharging pulse P2 is composed of a potential decreasing waveform for decreasing the potential from the first intermediate potential $V_{M1}$ to the negative pressure potential $V_L$, a potential holding waveform for holding the negative pressure potential $V_L$, and a potential increasing waveform for increasing the potential from the negative pressure potential $V_L$ to the reference potential $V_H$. The third ink discharging pulse P3 is composed of a potential decreasing waveform for decreasing the potential from the reference potential $V_H$ to the negative pressure potential $V_L$, a potential holding waveform for holding the negative pressure potential $V_L$, and a potential increasing waveform for increasing the potential from the negative pressure potential $V_L$ to the first intermediate potential $V_{M1}$. The fourth ink discharging pulse P4 is composed of a potential decreasing waveform for decreasing the potential from the first intermediate potential $V_{M1}$ to the negative pressure potential $V_L$, a potential holding waveform for holding the negative pressure potential $V_L$, and a potential increasing waveform for increasing the potential from the negative pressure potential $V_L$ to the reference potential $V_H$.

The auxiliary pulse P5 is composed of a potential decreasing waveform for decreasing the potential from the reference potential $V_H$ to a second intermediate potential $V_{M2}$, a potential holding waveform for holding the second intermediate potential $V_{M2}$, and a potential increasing waveform for increasing the potential from the second intermediate potential $V_{M2}$ to the reference potential $V_H$.

The potentials $V_H$, $V_L$, $V_{M1}$ and $V_{M2}$, the interval $t_{B1}$ of the first pulse P1, the interval $t_{B2}$ of the second pulse P2, the interval $t_{B3}$ of the third pulse P3, the interval $t_{B4}$ of the fourth pulse P4, the potential transition time $t_{f1}$ of the potential decreasing waveform of the first pulse P1, the potential transition time $t_{f2}$ of the potential decreasing waveform of the second pulse P2, and the driving frequency H=1/T, are set to values as shown in Table 8 below. The natural period (Helmholtz natural period) of the actuator is 8 μs. Note that the term "pulse interval" herein means the double length of time from the start of the potential decrease to the end of the potential increase for the first pulse P1, and means the length of time from the end of the potential increase of the previous pulse to the end of the potential increase of the current pulse for ink discharging pulses other than the first pulse P1 (i.e., the second to fourth pulses P2 to P4).

TABLE 8

| Parameter | Value |
|---|---|
| $V_H$ | 24 V |
| $V_L$ | 0 V |
| $V_{M1}$ | 16 V |
| $V_{M2}$ | 17.5 V |
| $t_{B1}$ | 12.8 μs |
| $t_{B2}$ | 7.1 μs |
| $t_{B3}$ | 7.2 μs |
| $t_{B4}$ | 6.8 μs |
| $t_{f1}$ | 3.5 μs |
| $t_{f2}$ | 2.5 μs |
| 1/T | 5 kHz |

The auxiliary pulse P5 is for suppressing the residual vibration of ink meniscus after discharging ink. The interval between a ink discharging pulse and the auxiliary pulse P5, i.e., the interval between the end of the potential increase of the fourth pulse P4 and the start of the potential decrease of the auxiliary pulse P5, is preferably 0.5 to 1.5 times the natural period of the actuator. If this interval is too short, the vibration suppressing effect cannot be obtained sufficiently, and if it is too long, the printing cycle is unnecessarily increased, thereby slowing down the printing speed. The pulse height $V_H$-$V_{M2}$ of the auxiliary pulse P5 is preferably 0.1 to 0.3 times the potential difference $V_H$-$V_L$ between the reference potential $V_H$ and the negative pressure potential $V_L$. If the pulse height of the auxiliary pulse P5 is too small, the vibration suppressing effect cannot be obtained sufficiently, and if it is too large, ink may possibly be discharged.

Note that in order to improve the response speed of the recording operation, the potential transition time of the potential decreasing waveform of each pulse (i.e., the waveform falling time) is preferably less than or equal to the natural period of the actuator, and the potential holding time of the potential holding waveform for each potential level is preferably less than or equal to ½ of the natural period of the actuator.

In the driving signal P as described above, the first to fourth pulses P1 to P4 are set so that the actuator 10 is brought into resonance. Moreover, the first to fourth pulses P1 to P4 are set so that a plurality of ink droplets discharged by these pulses are merged together in flight. Furthermore, the first to fourth pulses P1 to P4 are set so that the ink droplet discharging velocity and the discharged ink volume take their peak values after the merge. Next, the ink droplet discharging velocity and the discharged ink volume of a merged ink droplet will be described with reference to FIG. 14B.

Figure 14A:
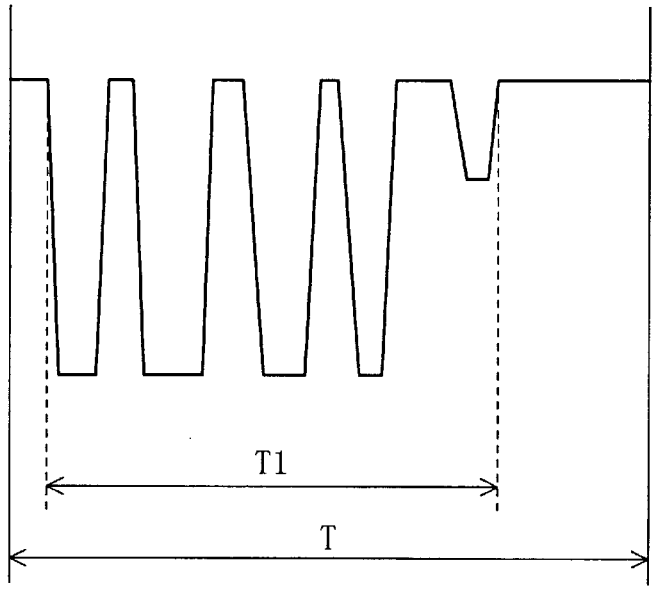
FIG. 14A is a waveform diagram illustrating a driving signal.
Figure 14B:
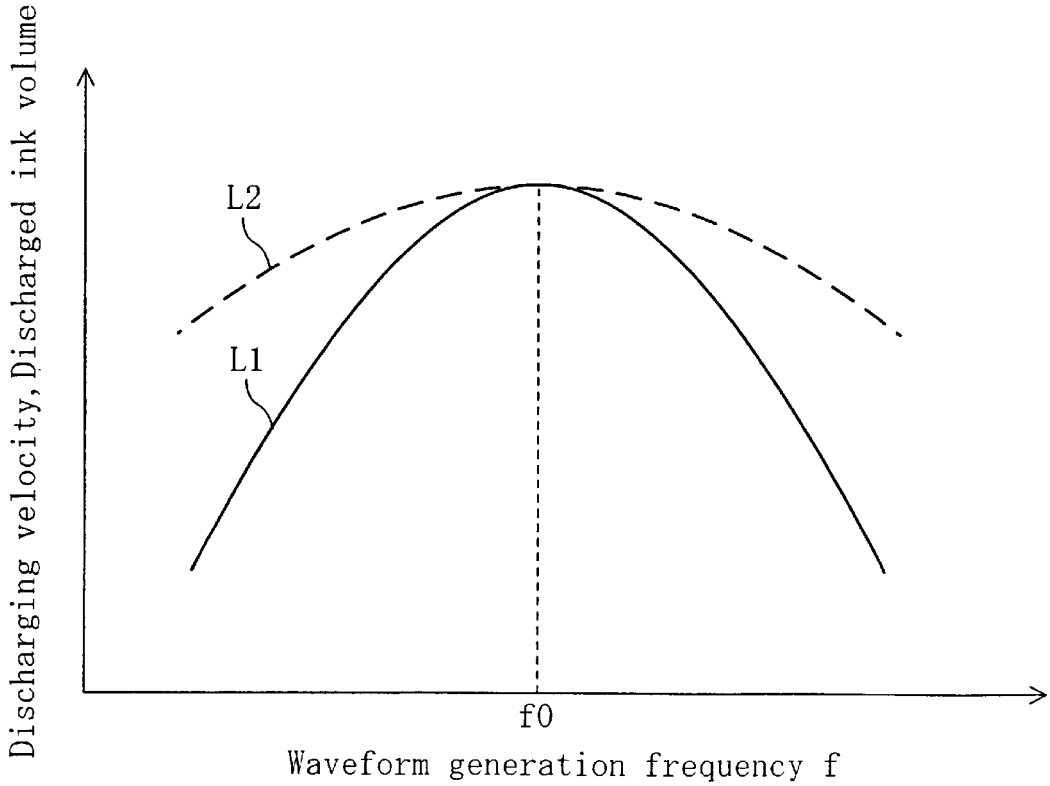
FIG. 14B is a graph illustrating a velocity curve and a discharged ink volume curve.

FIG. 14B is a graph illustrating the ink droplet discharging velocity and the discharged ink volume after the merge with respect to the waveform generation frequency f=k/T1 (where k is a constant) in a case where a driving signal having a pulse waveform as illustrated in FIG. 14A is supplied.

As described above, the term "waveform generation frequency" is a variable that indicates the degree of expansion/contraction when all pulse signals of a driving signal are expanded/contracted uniformly in the time axis direction. When a driving signal is modified, it is easier to uniformly expand/contract all the pulse signals in the time axis direction than to independently modify the individual pulse signal waveforms. In view of this, according to the present invention, a driving signal is uniformly expanded/contracted in the time axis direction. This requires some variable that indicates the degree of expansion/contraction. The "waveform generation frequency" is used herein as one such variable.

As illustrated in FIG. 14B, the velocity curve L1 representing the discharging velocity and the volume curve L2 representing the discharged ink volume are both curves that are protruding upward. The discharging velocity and the discharged ink volume both take their peak values when the waveform generation frequency f is equal to a predetermined frequency f0, and decrease as the waveform generation frequency f deviates from the predetermined frequency f0.

It can be seen from FIG. 14B that the discharging velocity and the discharged ink volume do not change substantially even when the waveform generation frequency f somewhat shifts, if the value of the waveform generation frequency f is equal or close to the predetermined frequency f0. Therefore, if the waveform generation frequency f of the ink jet head 1 is set to a value that is equal or close to the predetermined frequency f0, the variations in the discharging velocity and the discharged ink volume can be reduced even if the waveform generation frequency f varies among different actuators due to manufacturing errors, etc. Therefore, in the present embodiment, the waveform generation frequency f is set to be the predetermined frequency f0, and the driving signal P is composed as described above so that the ink droplet discharging velocity and the discharged ink volume take their peak values after the merge.

Figure 15:
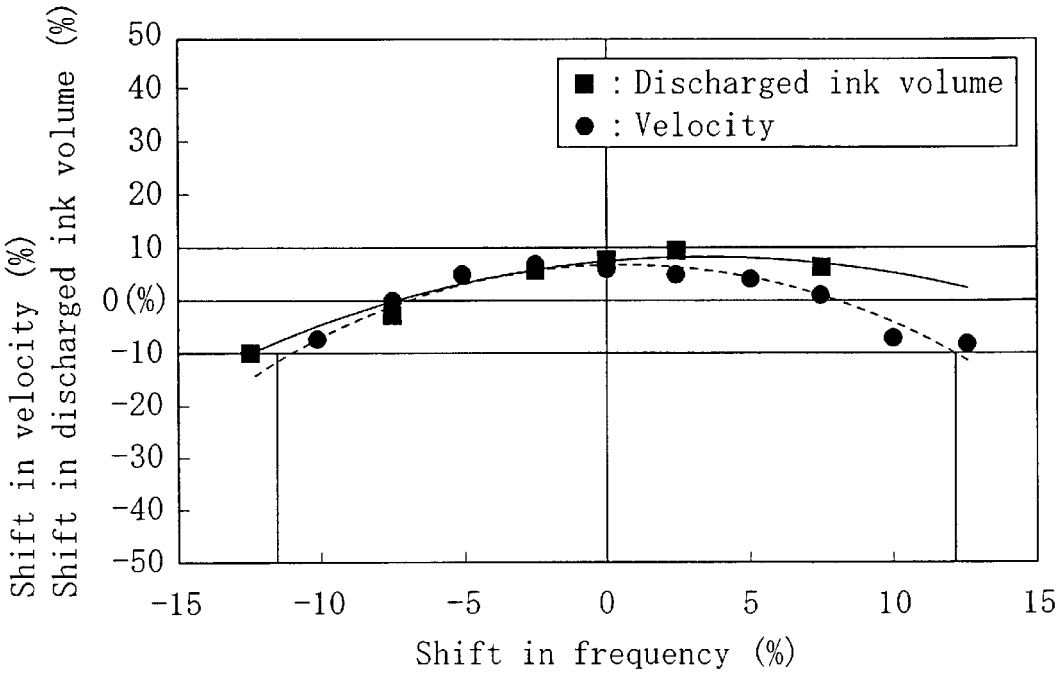
FIG. 15 is a graph illustrating the relationship between the shift in the resonance frequency and those in the discharging velocity and the discharged ink volume of a merged ink droplet.

FIG. 15 shows the shift in the discharging velocity of a merged ink droplet and the shift in the discharged ink volume of a merged ink droplet, with respect to the shift in the resonance frequency of the actuator, in a case where the driving signal P of the present embodiment is supplied. In FIG. 15, the horizontal axis represents the proportion by which the resonance frequency is shifted, and the vertical axis represents the proportion by which the discharging velocity shifts and the proportion by which the discharged ink volume shifts. It can be seen from FIG. 15 that with the driving signal P, the shift in the discharging velocity and discharged ink volume of a merged ink droplet can be suppressed within a range of −10% to +10% if the shift in the resonance frequency is within a range of −11% to +11%. In other words, the acceptable amount of shift in the resonance frequency for suppressing the shift in the discharging velocity and discharged ink volume within a ±10% range (hereinafter referred to as "resonance tolerance") is within about ±11%.

As described above, according to the present embodiment, the waveform generation frequency f of the driving signal P is set to be the predetermined frequency f0 at which the ink droplet discharging velocity and the discharged ink volume take their peak values after the merge, whereby the resonance tolerance can be increased from that in the prior art. Thus, it is possible to reduce the variations in the merged ink droplet landing position. Moreover, it is possible to suppress the variations in the size of an ink dot formed by the merged ink droplet, and to suppress the variations in the ink dot gradation. Therefore, it is possible to improve the recording quality with an ink jet head that utilizes resonance and discharges a plurality of ink droplets that are merged together in flight.

Note that if ink droplets are discharged by the ink discharging pulses P1 to P4 with excessively high discharging velocities, a later discharged ink droplet, catching up with a previously discharged ink droplet, may penetrate through the previously discharged ink droplet or the later discharged ink droplet may collide with the previously discharged ink droplet from an inclined angle so that the merged ink droplet rotates, thereby making the merge of ink droplets unstable. Particularly, in the present embodiment, in which the driving signal P is composed so that the discharging velocity of the merged ink droplet takes its peak value, the merge is likely to be unstable if the ink droplets are discharged with excessively high discharging velocities.

In view of this, according to the present embodiment, the intermediate potential $V_{M1}$, which is lower than the reference potential $V_H$, is provided in the driving signal P, in order to suppress the discharging velocity of each ink droplet. In this way, it is possible to suppress the discharging velocity of each ink droplet as compared with a case where only the reference potential $V_H$ and the negative pressure potential $V_L$ are used as the pulse potentials. Thus, the stability of the merge is improved.

Note however that the method for suppressing the discharging velocities of the ink droplets is not limited to the provision of an intermediate potential. For example, the provision of the intermediate potential may not be necessary when using a head that is designed to discharge ink with lower velocities and higher volumes. Thus, it is possible to improve the stability of the merge without providing the intermediate potential, by appropriately modifying the design of the head.

In the present embodiment, the frequency at which the discharging velocity takes its peak value coincides with the frequency at which the discharged ink volume takes its peak value. However, these frequencies may alternatively be different from each other.

Note that in the ink jet head 1, the driving signal P is set, before the ink jet head 1 is manufactured, so that the waveform generation frequency f is equal to the predetermined frequency f0. Alternatively, the driving signal P may be set after the ink jet head 1 is manufactured. In such a case, however, the resonance frequency may vary among different actuators 10 due to manufacturing errors, etc., and it is expected that the predetermined frequency at which the discharging velocity or the discharged ink volume takes its peak value may vary among different actuators. In view of this, it is preferred that the waveform generation frequency f of the driving signal P is set with respect to a particular actuator having average characteristics (hereinafter referred to as "reference actuator").

For example, the resonance frequency can be measured for all, or a majority, of the actuators, and the average value of the resonance frequencies can be calculated. Then, an actuator having the same resonance frequency as the average value can be specified as the reference actuator. Alternatively, a reference actuator may be specified based on the evaluation of a recorded image, e.g., based on the landing position of a merged ink droplet, the diameter of an ink dot, etc.

Embodiment 6

In Embodiment 6, the driving signal P is composed so that the discharged ink volume of a merged ink droplet is located along the declining portion of the resonance curve (the discharged ink volume curve L2).

Figure 16:
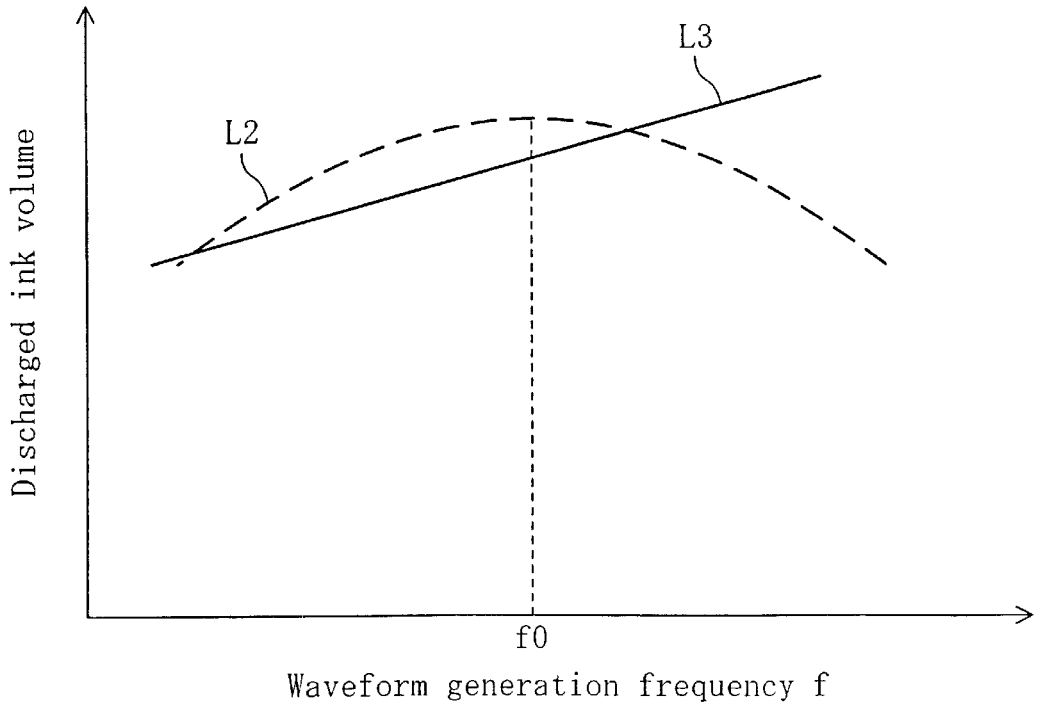
FIG. 16 is a graph illustrating a discharged ink volume curve that is associated with resonance, and another discharged ink volume curve that is associated with the amount of deformation of an actuator.

Factors that cause the variations in the ink dot size of the merged ink droplet include the variations in the amount of deformation among actuators, in addition to the variations in the resonance frequency among actuators. Typically, the amount of deformation of an actuator decreases and thus the discharged ink volume also decreases as the resonance frequency increases. Now, the waveform of the driving signal elongates apparently as the resonance frequency of the entire vibration system including ink increases. This is equivalent to a decrease in the waveform generation frequency. Thus, the discharged ink volume decreases as the amount of deformation of an actuator decreases, i.e., as the waveform generation frequency decreases. Therefore, the line or curve L3 that is associated with the amount of deformation of the actuator 10 and that represents a change in the discharged ink volume with respect to a change in the waveform generation frequency f is a rising line or curve, as illustrated in FIG. 16. Thus, with regard to the change in the amount of deformation of the actuator 10, the discharged ink volume increases as the waveform generation frequency f increases.

Thus, as the waveform generation frequency f increases, for example, the degree of resonance decreases. Therefore, if the driving signal P is set so that the discharged ink volume of a merged ink droplet is located along the declining portion of the discharged ink volume curve L2, the decrease in the discharged ink volume due to the change in the resonance frequency is canceled out by the increase in the discharged ink volume due to the change in the amount of deformation of the actuator 10. As a result, the variations in the discharged ink volume are suppressed. Thus, by setting the waveform generation frequency f to be greater than the predetermined frequency f0, at which the discharged ink volume takes its peak value, it is possible to suppress the variations in the discharged ink volume and to suppress the variations in the ink dot size. In this way, it is possible to improve the recording quality.

Note that in order to decrease both the variations in the resonance and the variations in the amount of deformation, it is preferred that the discharged ink volume of a merged ink droplet is in the vicinity of the peak value. It is preferred that the waveform generation frequency f is in the vicinity of the predetermined frequency f0. Moreover, it is preferred that waveform generation frequency f is set so that the shift in the discharged ink volume is within a range of −10% to +10%.

Alternative Embodiments

The number of pulses of a driving signal to be applied in one printing cycle is not limited to 2, 3 or 4, but may alternatively be 5 or more.

A pulse signal to be included in the driving signal is not limited to a so-called "pull-push pulse", which first depressurizes, and then pressurizes, the pressure chamber 4. The pulse signal may alternatively be a so-called "push-pull pulse", which first pressurizes, and then depressurizes, the pressure chamber 4, or a pulse having any other appropriate waveform.

The pulse waveform is not limited to a trapezoidal waveform, but may alternatively be any other appropriate waveform such as a rectangular waveform, a triangular waveform, a sinusoidal waveform, etc.

The present invention is not limited to the embodiments set forth above, but may be carried out in various other ways without departing from the spirit or main features thereof.

Thus, the embodiments set forth above are merely illustrative in every respect, and should not be taken as limiting. The scope of the present invention is defined by the appended claims, and in no way is limited to the description set forth herein. Moreover, any variations and/or modifications that are equivalent in scope to the claims fall within the scope of the present invention.

What is claimed is:

1. An ink jet recording apparatus, comprising:

a head body provided with a plurality of nozzles and a plurality of pressure chambers, which are communicated to the respective nozzles and are filled with ink;

a plurality of actuators provided in the head body each including a piezoelectric element and an electrode for applying a voltage across the piezoelectric element for applying a pressure on the ink in one of the pressure chambers so as to discharge ink from one of the nozzles; and a driving circuit for supplying a signal to the electrode of each actuator, wherein:

the driving circuit applies, in one printing cycle, a driving signal composed of a plurality of pulse signals for discharging a plurality of ink droplets so that the ink droplets are merged together in flight; and the driving signal includes a pulse signal applied with an interval that is shorter than a predetermined pulse interval being equal to a Helmholtz period of a head, and a pulse signal applied with an interval that is longer than the predetermined pulse interval.

2. The ink jet recording apparatus of claim 1, wherein the plurality of pulse signals included in the driving signal are applied in an order such that an absolute value of a difference between the pulse interval thereof and the predetermined pulse interval gradually decreases.

3. The ink jet recording apparatus of claim 2, wherein:

the driving signal includes a first pulse signal, a second pulse signal and a third pulse signal; and two of the first to third pulse signals have pulse intervals that are shorter than the predetermined pulse interval, with the other pulse signal having a pulse interval that is longer than the predetermined pulse interval.

4. The ink jet recording apparatus of claim 3, wherein a thickness of the piezoelectric element is set to be 0.5 $\mu$m to 5 $\mu$m.

5. The ink jet recording apparatus of claim 2, wherein:

the driving signal includes a first pulse signal, a second pulse signal and a third pulse signal; and two of the first to third pulse signals have pulse intervals that are longer than the predetermined pulse interval, with the other pulse signal having a pulse interval that is shorter than the predetermined pulse interval.

6. The ink jet recording apparatus of claim 5, wherein a thickness of the piezoelectric element is set to be 0.5 $\mu$m to 5 $\mu$m.

7. An ink jet recording apparatus, comprising:

a head body provided with a plurality of nozzles and a plurality of pressure chambers, which are communicated to the respective nozzles and are filled with ink;

a plurality of actuators provided in the head body each including a piezoelectric element and an electrode for applying a voltage across the piezoelectric element for applying a pressure on the ink in one of the pressure chambers so as to discharge ink from one of the nozzles; and a driving circuit for supplying a signal to the electrode of each actuator, wherein:

the driving circuit applies, in one printing cycle, a driving signal composed of a plurality of pulse signals for discharging a plurality of ink droplets so that the ink droplets are merged together in flight; and the driving signal includes a pulse signal applied with an interval that is shorter than a predetermined pulse interval that maximizes an ink droplet discharging velocity, and a pulse signal applied with an interval that is longer than the predetermined pulse interval.

8. The ink jet recording apparatus of claim 7, wherein the plurality of pulse signals included in the driving signal are applied in an order such that an absolute value of a difference between the pulse interval thereof and the predetermined pulse interval gradually decreases.

9. The ink jet recording apparatus of claim 8, wherein:

the driving signal includes a first pulse signal, a second pulse signal and a third pulse signal; and two of the first to third pulse signals have pulse intervals that are shorter than the predetermined pulse interval, with the other pulse signal having a pulse interval that is longer than the predetermined pulse interval.

10. The ink jet recording apparatus of claim 9, wherein a thickness of the piezoelectric element is set to be 0.5 $\mu$m to 5 $\mu$m.

11. The ink jet recording apparatus of claim 8, wherein:

the driving signal includes a first pulse signal, a second pulse signal and a third pulse signal; and two of the first to third pulse signals have pulse intervals that are longer than the predetermined pulse interval, with the other pulse signal having a pulse interval that is shorter than the predetermined pulse interval.

12. The ink jet recording apparatus of claim 11, wherein a thickness of the piezoelectric element is set to be 0.5 $\mu$m to 5 $\mu$m.

13. An ink jet recording apparatus, comprising:

a head body provided with a plurality of nozzles and a plurality of pressure chambers, which are communicated to the respective nozzles and are filled with ink;

a plurality of actuators provided in the head body each including a piezoelectric element and an electrode for applying a voltage across the piezoelectric element for applying a pressure on the ink in one of the pressure chambers so as to discharge ink from one of the nozzles; and a driving circuit for supplying a signal to the electrode of each actuator, wherein:

the driving circuit applies, in one printing cycle, a driving signal composed of a plurality of pulse signals for discharging a plurality of ink droplets so that the ink droplets are merged together in flight; and the driving signal includes a pulse signal having a pulse width that is shorter than a predetermined pulse width being equal to one half of a Helmholtz period of a head, and a pulse signal having a pulse width that is longer than the predetermined pulse width.

14. The ink jet recording apparatus of claim 13, wherein the plurality of pulse signals included in the driving signal are applied in an order such that an absolute value of a difference between the pulse width thereof and the predetermined pulse width gradually decreases.

15. The ink jet recording apparatus of claim 14, wherein:

the driving signal includes a first pulse signal, a second pulse signal and a third pulse signal; and two of the first to third pulse signals have pulse widths that are shorter than the predetermined pulse width, with the other pulse signal having a pulse width that is longer than the predetermined pulse width.

16. The ink jet recording apparatus of claim 15, wherein a thickness of the piezoelectric element is set to be 0.5 $\mu$m to 5 $\mu$m.

17. The ink jet recording apparatus of claim 14, wherein:

the driving signal includes a first pulse signal, a second pulse signal and a third pulse signal; and two of the first to third pulse signals have pulse widths that are longer than the predetermined pulse width, with the other pulse signal having a pulse width that is shorter than the predetermined pulse width.

18. The ink jet recording apparatus of claim 17, wherein a thickness of the piezoelectric element is set to be 0.5 $\mu$m to 5 $\mu$m.

19. An ink jet recording apparatus, comprising:

a head body provided with a plurality of nozzles and a plurality of pressure chambers, which are communicated to the respective nozzles and are filled with ink;

a plurality of actuators provided in the head body each including a piezoelectric element and an electrode for applying a voltage across the piezoelectric element for applying a pressure on the ink in one of the pressure chambers so as to discharge ink from one of the nozzles; and a driving circuit for supplying a signal to the electrode of each actuator, wherein:

the driving circuit applies, in one printing cycle, a driving signal composed of a plurality of pulse signals for discharging a plurality of ink droplets so that the ink droplets are merged together in flight; and the driving signal includes a pulse signal having a pulse width that is shorter than a predetermined pulse width that maximizes an ink droplet discharging velocity, and a pulse signal having a pulse width that is longer than the predetermined pulse width.

20. The ink jet recording apparatus of claim 19, wherein the plurality of pulse signals included in the driving signal are applied in an order such that an absolute value of a difference between the pulse width thereof and the predetermined pulse width gradually decreases.

21. The ink jet recording apparatus of claim 20, wherein:

the driving signal includes a first pulse signal, a second pulse signal and a third pulse signal; and two of the first to third pulse signals have pulse widths that are shorter than the predetermined pulse width, with the other pulse signal having a pulse width that is longer than the predetermined pulse width.

22. The ink jet recording apparatus of claim 21, wherein a thickness of the piezoelectric element is set to be 0.5 $\mu$m to 5 $\mu$m.

23. The ink jet recording apparatus of claim 20, wherein:

the driving signal includes a first pulse signal, a second pulse signal and a third pulse signal; and two of the first to third pulse signals have pulse widths that are longer than the predetermined pulse width, with the other pulse signal having a pulse width that is shorter than the predetermined pulse width.

24. The ink jet recording apparatus of claim 23, wherein a thickness of the piezoelectric element is set to be 0.5 $\mu$m to 5 $\mu$m.

25. An ink jet recording apparatus, comprising:

a head body provided with a plurality of nozzles and a plurality of pressure chambers, which are communicated to the respective nozzles and are filled with ink;

a plurality of actuators provided in the head body each including a piezoelectric element and an electrode for applying a voltage across the piezoelectric element for applying a pressure on the ink in one of the pressure chambers so as to discharge ink from one of the nozzles; and a driving circuit for supplying a signal to the electrode of each actuator, wherein:

the driving circuit applies, in one printing cycle, a driving signal composed of a plurality of pulse signals for bringing the actuator into resonance and discharging a plurality of ink droplets so that the ink droplets are merged together in flight; and a waveform generation frequency of the driving signal is set to be equal to a predetermined frequency at which a discharging velocity takes its peak value in an upwardly-protruding velocity curve in which the waveform generation frequency is a variable for a horizontal axis and a discharging velocity of a merged ink droplet is a variable for a vertical axis.

26. The ink jet recording apparatus of claim 25, wherein:

each pulse signal of the driving signal has a potential decreasing waveform for depressurizing the pressure chamber, a potential holding waveform for holding a potential and a potential increasing waveform for pressurizing the pressure chamber so that an ink droplet is discharged when the pressure chamber is pressurized after it is depressurized;

a potential falling time of the potential decreasing waveform of the pulse signal is set to be less than or equal to a natural period of the actuator; and a potential holding time of the potential holding waveform of the pulse signal is set to be less than or equal to ½ of the natural period of the actuator.

27. An ink jet recording apparatus, comprising:

a head body provided with a plurality of nozzles and a plurality of pressure chambers, which are communicated to the respective nozzles and are filled with ink;

a plurality of actuators provided in the head body each including a piezoelectric element and an electrode for applying a voltage across the piezoelectric element for applying a pressure on the ink in one of the pressure chambers so as to discharge ink from one of the nozzles; and a driving circuit for supplying a signal to the electrode of each actuator, wherein:

the driving circuit applies, in one printing cycle, a driving signal composed of a plurality of pulse signals for bringing the actuator into resonance and discharging a plurality of ink droplets so that the ink droplets are merged together in flight; and a waveform generation frequency of the driving signal is set to be equal to a predetermined frequency at which a discharged ink volume takes its peak value in an upwardly-protruding discharged ink volume curve in which the waveform generation frequency is a variable for a horizontal axis and a discharged ink volume of a merged ink droplet is a variable for a vertical axis.

28. The ink jet recording apparatus of claim 27, wherein:

each pulse signal of the driving signal has a potential decreasing waveform for depressurizing the pressure chamber, a potential holding waveform for holding a potential and a potential increasing waveform for pressurizing the pressure chamber so that an ink droplet is discharged when the pressure chamber is pressurized after it is depressurized;

a potential falling time of the potential decreasing waveform of the pulse signal is set to be less than or equal to a natural period of the actuator; and a potential holding time of the potential holding waveform of the pulse signal is set to be less than or equal to ½ of the natural period of the actuator.

29. An ink jet recording apparatus, comprising:

a head body provided with a plurality of nozzles and a plurality of pressure chambers, which are communicated to the respective nozzles and are filled with ink;

a plurality of actuators provided in the head body each including a piezoelectric element and an electrode for applying a voltage across the piezoelectric element for applying a pressure on the ink in one of the pressure chambers so as to discharge ink from one of the nozzles; and a driving circuit for supplying a signal to the electrode of each actuator, wherein:

the driving circuit applies, in one printing cycle, a driving signal composed of a plurality of pulse signals for bringing the actuator into resonance and discharging a plurality of ink droplets so that the ink droplets are merged together in flight; and a waveform generation frequency of the driving signal is set to be greater than a predetermined frequency at which a discharged ink volume takes its peak value in an upwardly-protruding discharged ink volume curve in which the waveform generation frequency is a variable for a horizontal axis and a discharged ink volume of a merged ink droplet is a variable for a vertical axis.

30. The ink jet recording apparatus of claim 29, wherein:

each pulse signal of the driving signal has a potential decreasing waveform for depressurizing the pressure chamber, a potential holding waveform for holding a potential and a potential increasing waveform for pressurizing the pressure chamber so that an ink droplet is discharged when the pressure chamber is pressurized after it is depressurized;

a potential falling time of the potential decreasing waveform of the pulse signal is set to be less than or equal to a natural period of the actuator; and a potential holding time of the potential holding waveform of the pulse signal is set to be less than or equal to ½ of the natural period of the actuator.

* * * * *